US009454117B2

(12) United States Patent
Obata et al.

(10) Patent No.: US 9,454,117 B2
(45) Date of Patent: Sep. 27, 2016

(54) FIXING DEVICE

(71) Applicant: CANON KABUSHIKI KAISHA, Tokyo (JP)

(72) Inventors: Seiji Obata, Mishima (JP); Koji Uchiyama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/571,169

(22) Filed: Dec. 15, 2014

(65) Prior Publication Data

US 2015/0168881 A1 Jun. 18, 2015

(30) Foreign Application Priority Data

Dec. 18, 2013 (JP) ..... 2013-261512

(51) Int. Cl.
*G03G 15/20* (2006.01)

(52) U.S. Cl.
CPC ..... *G03G 15/206* (2013.01); *G03G 15/2053* (2013.01); *G03G 15/2057* (2013.01); *G03G 2215/2016* (2013.01); *G03G 2215/2035* (2013.01)

(58) Field of Classification Search
CPC ..... G03G 15/2053; G03G 15/2057; G03G 15/206; G03G 2215/2016; G03G 2215/2035
See application file for complete search history.

(56) References Cited

U.S. PATENT DOCUMENTS

| | | | | |
|---|---|---|---|---|
| 6,021,303 | A * | 2/2000 | Terada et al. | 399/328 |
| 6,049,691 | A * | 4/2000 | Abe G03G 15/2064 | 219/619 |
| 2009/0208265 | A1* | 8/2009 | Nakamoto et al. | 399/329 |
| 2012/0093546 | A1* | 4/2012 | Ohara et al. | 399/329 |
| 2013/0188978 | A1* | 7/2013 | Takeuchi | 399/329 |
| 2014/0064786 | A1* | 3/2014 | Mogi | 399/122 |

FOREIGN PATENT DOCUMENTS

| | | | |
|---|---|---|---|
| JP | 2004-94146 | A | 3/2004 |
| JP | 2007-079224 | A | 3/2007 |
| JP | 2013-195862 | A | 9/2013 |

* cited by examiner

*Primary Examiner* — Ryan Walsh
(74) *Attorney, Agent, or Firm* — Canon U.S.A., Inc. IP Division

(57) ABSTRACT

A metal plate, which reinforces a backup member in contact with an inner surface of a fixing film, has a flat portion pressed against the backup member. The fixing film includes an electrically conductive layer. A current flows through the electrically conductive layer entirely in a circumferential direction of the fixing film, thereby causing the fixing film to generate heat.

16 Claims, 15 Drawing Sheets

FIXING DEVICE

BACKGROUND OF THE INVENTION

1. Field of the Invention

The present invention relates to a fixing device used for an electrophotographic image forming apparatus.

2. Description of the Related Art

Nowadays, fixing devices increasingly use a cylindrical film (also referred to as a belt) as a fixing rotating member. These fixing devices use a film so as to reduce heat capacity and power consumed by the fixing device. In some of the fixing devices using the film, a ceramic heater is in contact with an inner surface of the film or a halogen heater is used as a heat source.

Since the film has flexibility, in order to form a fixing nip portion in the fixing device using the film, a backup member is required. The backup member is in contact with the inner surface of the film and backs up the film from the inside of the film. Furthermore, in order to suppress bending of the backup member, which is caused by a load required to form the fixing nip portion and applied to the backup member, it is required that the backup member be reinforced by a metal reinforcing member (stay) serving as a beam. When the ceramic heater is used, the heater or a heater holder which is made of resin serves as the backup member. When the halogen heater is used, a molded component which is made of resin or a sheet-shaped backup member is provided between the reinforcing member and the film.

When continuously printing on small-sized recording media, as one of methods to suppress reduction in the number of sheets output per unit time, the width of the fixing nip portion in the recording medium conveying direction may be increased. When the nip width is increased, control target temperature (fixing temperature) can be correspondingly reduced during fixing of toner images. This can suppress an increase in temperature in a sheet non-passing portion of the fixing device where the recording media does not pass through. Since the increase in temperature in the sheet non-passing portion can be reduced, reduction in the number of sheets output per unit time can be suppressed. In order to increase the nip width of the fixing device using the film, it is required that the width of the backup member in the recording medium conveying direction be increased. When the width of the backup member is increased, it is required that a region of the backup member to be reinforced by the reinforcing member be increased.

In order to reduce the weight of the reinforcing member while obtaining the moment of inertia of area, a metal plate having been bent to have a U-shaped section is used in many fixing devices. When the ceramic heater is used in the fixing device, it is required that a sensor that monitors the temperature of the heater and a protection element (a temperature fuse or a thermo switch) that has a switching structure for cutting off power supply to the heater in an emergency be disposed on a rear surface of the heater. In order to arrange these elements on the rear surface of the heater, a through hole is provided in the heater holder. Furthermore, in order to route the wiring of these elements to the outside of the cylindrical film, leg portions of the U-shape of the reinforcing member are pressed against the heater holder so as to provide a space for routing the wiring. However, when the leg portions of the U-shape of the reinforcing member are in contact with the backup member for reinforcement, it is unlikely that a large region of the backup member is reinforced because of a contact region, where the reinforcing member and the backup member are in contact with each other, is small.

When a flat portion, which is a bottom portion of the U-shape of the reinforcing member, can be in contact with the backup member for reinforcement, a large region of the backup member can be reinforced. Thus, such a structure is suitable for increasing the nip width. However, as described above, when the ceramic heater is used in the fixing device, the space is required for the elements disposed on the rear surface of the heater and for the wiring of the elements. Thus, it is unlikely to use a configuration in which the flat portion of the reinforcing member is pressed against the backup member.

Alternatively, a heat source such as a halogen heater may be used for radiating heat to the film. In this case, it is not required to provide the through hole for arranging the elements including the protection element in the backup member. Thus, the configuration in which the flat portion of the reinforcing member is pressed against the backup member can be adopted (Japanese Patent Laid-Open No. 2004-94146). With the method by which the film is heated by radiant light, a large region of the film in the circumferential direction can be heated. Thus, a time period taken to warm up the film to the temperature, at which fixing is possible, can be reduced.

However, the method by which the film is heated by the radiant light is used and the flat portion of the reinforcing member is pressed against the backup member as described above, the reinforcing member blocks the radiant light, thereby limiting a region of the film exposed to the radiant light. When the region of the film exposed to the radiant light is reduced, the temperature of the film required for fixing is unlikely to be obtained. Although the heating region can be increased by increasing the diameter of the film, this increases the heat capacity of the film.

SUMMARY OF THE INVENTION

The present invention provides a fixing device in which a large region of a film can be heated in a circumferential direction of the film even when the width of a fixing nip portion is increased.

The present invention provides a fixing device that includes a cylindrical fixing film, a backup member, a nip portion forming member, and a metal plate. The backup member is in contact with an inner surface of the fixing film and backs up the fixing film. The nip portion forming member is in contact with an outer surface of the fixing film. The nip portion forming member and the backup member form a fixing nip portion with the fixing film interposed therebetween. The metal plate is provided on a surface on a side opposite to a surface on a side where the backup member is in contact with the fixing film. The metal plate reinforces the backup member. In the fixing device, the metal plate has a flat portion pressed against the backup member. In the fixing device, the fixing film includes an electrically conductive layer, and a current flows through the entire electrically conductive layer in a circumferential direction of the fixing film, thereby causing the fixing film to generate heat.

Further features of the present invention will become apparent from the following description of exemplary embodiments with reference to the attached drawings.

DESCRIPTION OF THE EMBODIMENTS

First Embodiment

Figure 1:
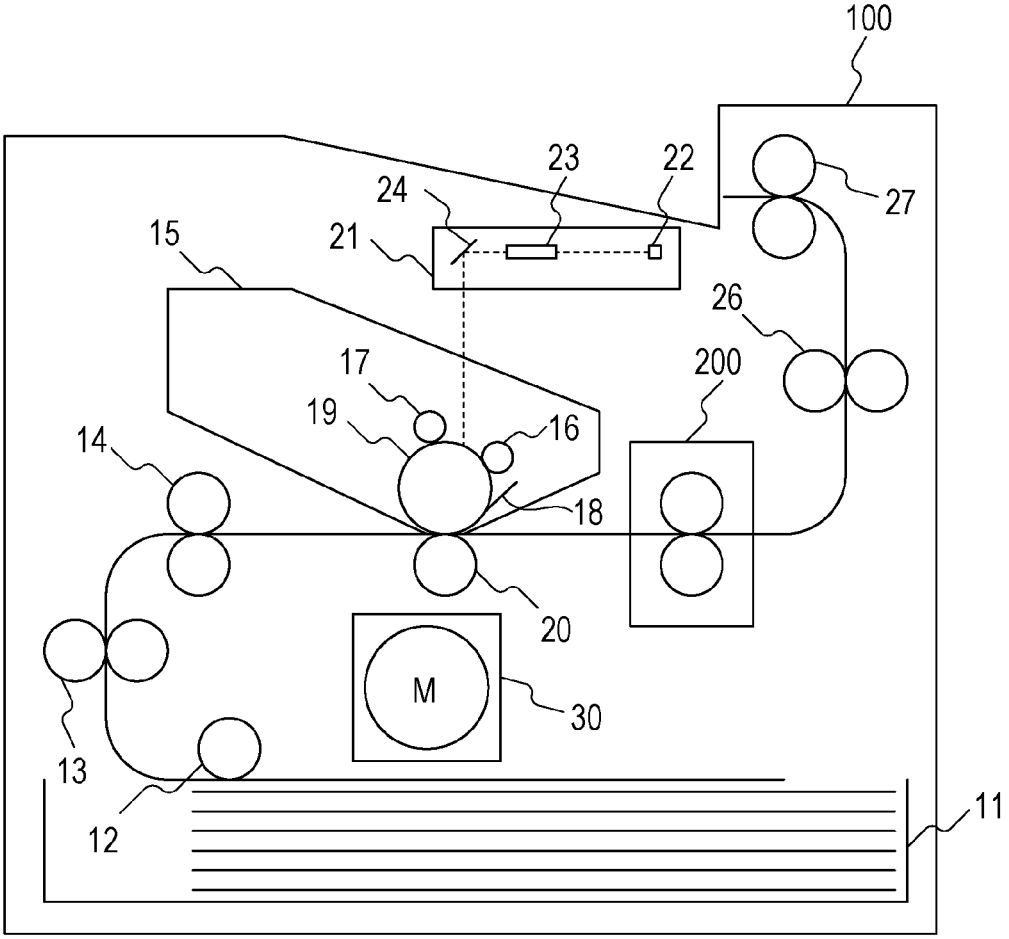
FIG. 1 is a sectional view of an image forming apparatus.

FIG. 1 is a sectional view of a laser printer (image forming apparatus) 100 using an electrophotography. When a print signal is generated, a semiconductor laser 22 emits laser light modulated in accordance with image information. The laser light is deflected by a polygon mirror 23 and output from a scanner unit 21 through a reflecting mirror 24. The laser light scans a photosensitive member 19 having been charged to a specified polarity by a charging roller 16. Thus, an electrostatic latent image is formed on the photosensitive member 19. Toner is supplied from a developing device 17 to the electrostatic latent image, thereby forming a toner image on the photosensitive member 19 in accordance with the image information. Meanwhile, recording media P stacked one on top of another in a sheet supplying cassette 1 is fed one after another by a pickup roller 12 and conveyed to a registration roller 14 by a roller 13. The recording media P are each further conveyed to a transfer position, which is formed by the photosensitive member 19 and a transfer roller 20, through the registration roller 14 at timing adjusted to arrival of the toner image on the photosensitive member 19 at the transfer position. The toner image on the photosensitive member 19 is transferred onto the recording medium P through a process in which the recording medium P passes through the transfer position. After that, the recording medium P is heated by a fixing unit 200, thereby heat fixing the toner image onto the recording medium P. The recording medium P that carries fixed toner image is ejected to a tray provided in an upper portion of the image forming apparatus 100 by rollers 26 and 27. Reference numerals 18 and 30 respectively denote a cleaner and a motor. The cleaner 18 cleans the photosensitive member 19, and the motor 30 drives the fixing unit 200 and so forth. The above-described photosensitive member 19, charging roller 16, scanner unit 21, developing device 17, and transfer roller 20 are included in an image forming section that forms unfixed images on the recording media P. Reference numeral 15 denotes a cartridge that houses the charging roller 16, the developing device 17, the photosensitive member 19, and the cleaner 18. The cartridge 15 is detachably attached to an image forming apparatus main body.

Figure 2:
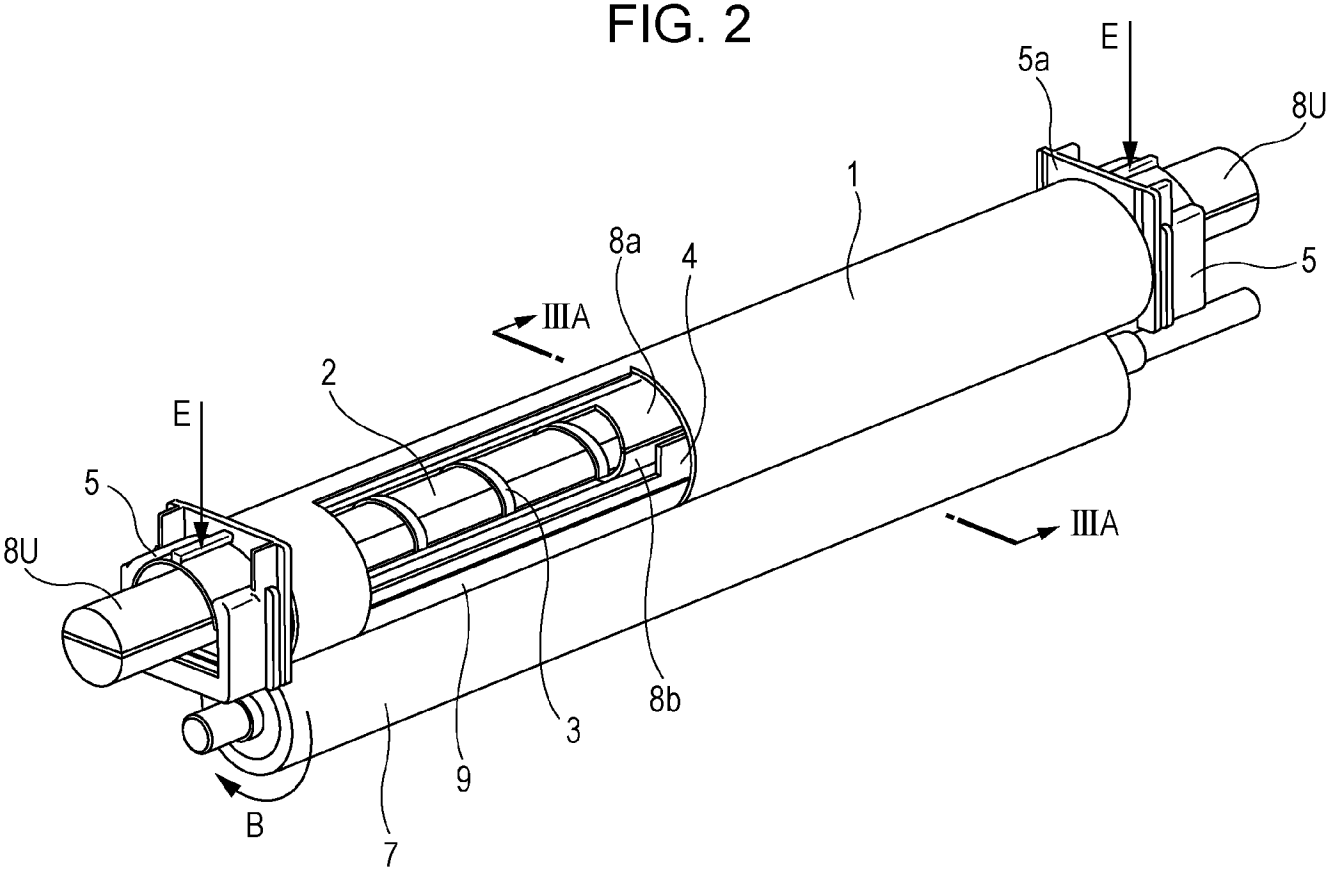
FIG. 2 is a perspective view of a fixing device.
Figure 3A:
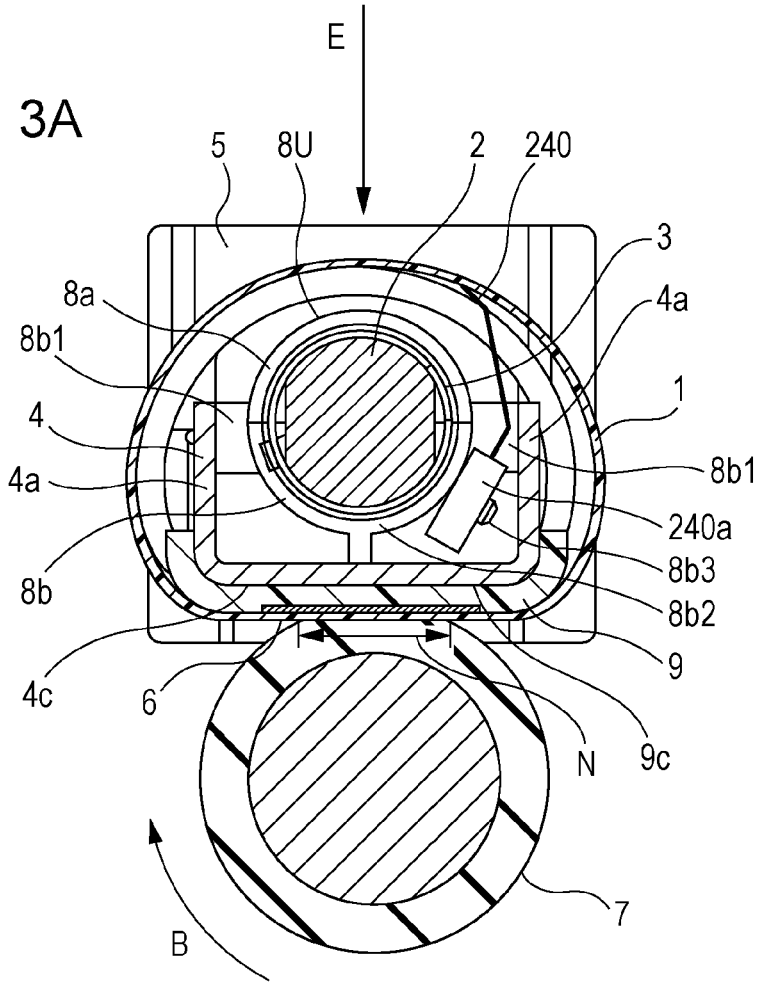
FIGS. 3A and 3B are sectional views of the fixing device and a film.
Figure 3B:
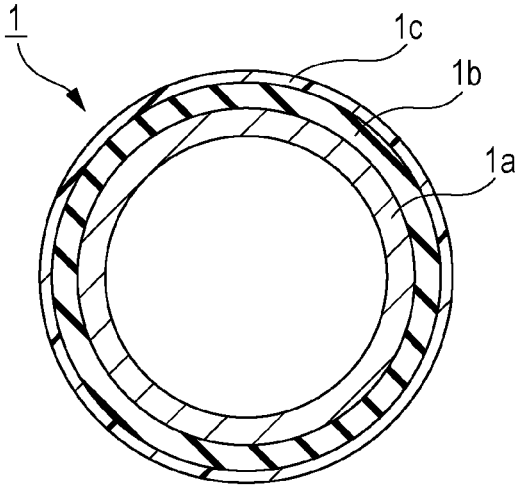
Figure 4:
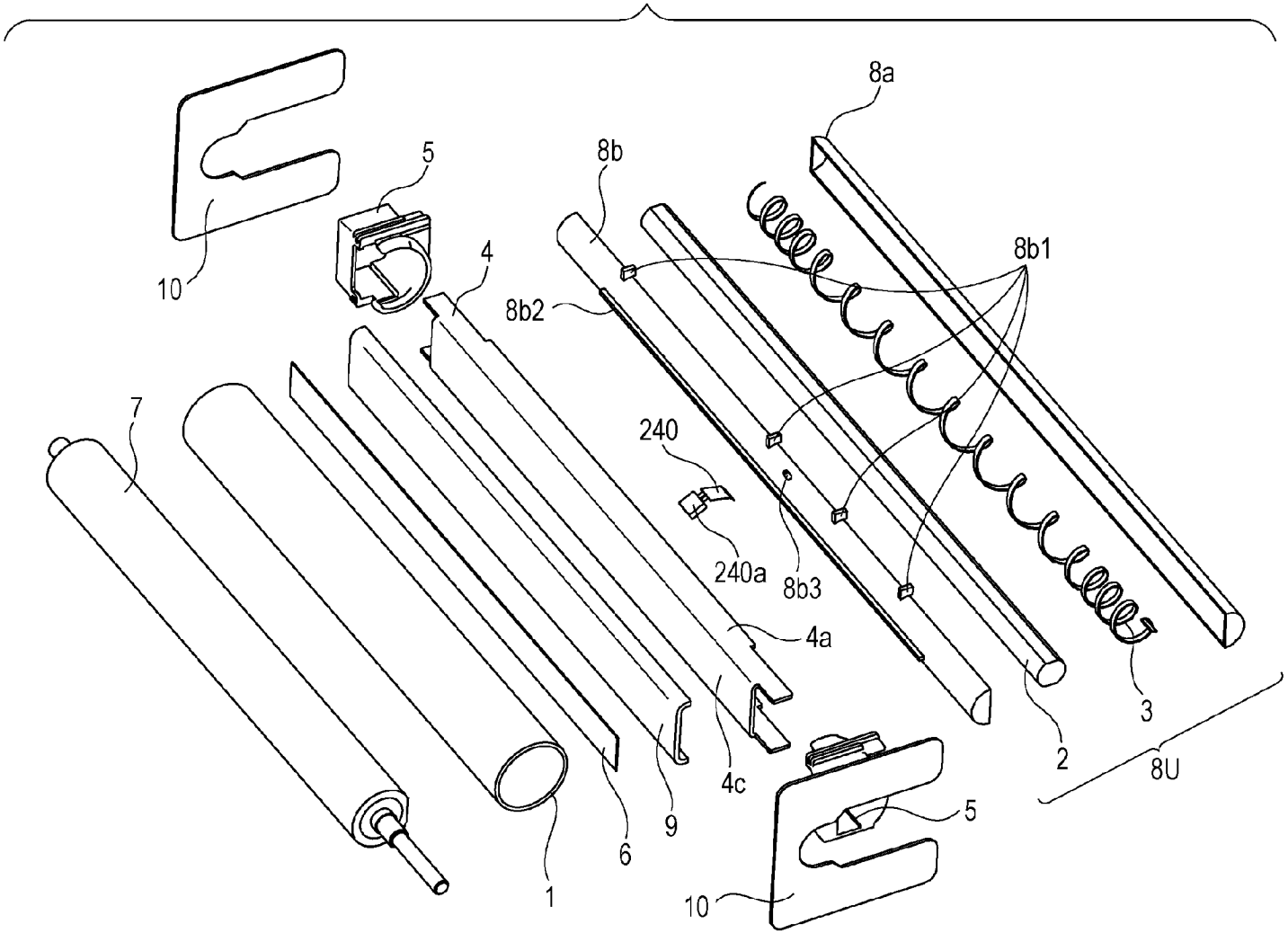
FIG. 4 is an exploded view of the fixing device.
Figure 5A:
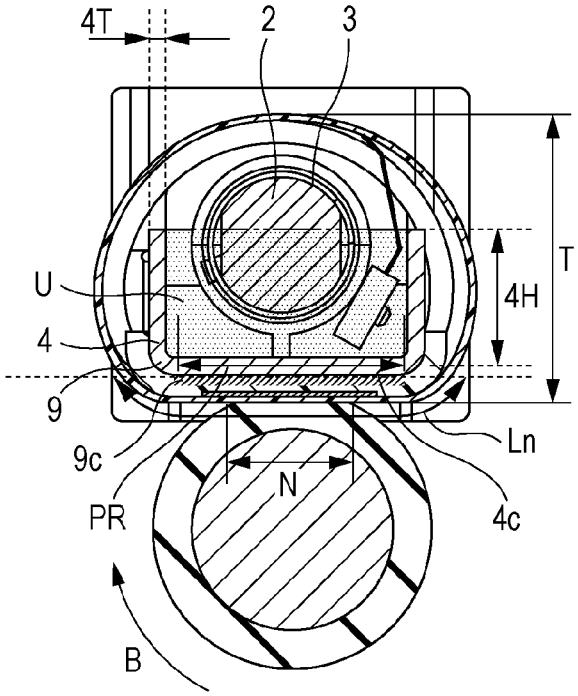
FIGS. 5A to 5C illustrate an internal layout of the fixing device.

Next, the fixing device (fixing unit) 200 is described with reference to FIGS. 2 to 5A. Electromagnetic induction heating is adopted for the fixing device 200. FIG. 2 is a perspective view of the fixing device. FIG. 3A is a sectional view of the fixing device taken along line IIIA-IIIA in FIG. 2. FIG. 3B is a sectional view of a fixing film 1. FIG. 4 is an exploded perspective view of the fixing device. FIG. 5A illustrates the relationship between a magnetic core 2 and a stay 4. In FIGS. 2 to 5A, reference numeral 1 denotes the cylindrical fixing film (fixing belt), reference numeral 7 denotes a pressure roller (nip portion forming member), reference numeral 4 denotes the stay (reinforcing member) as a beam, reference numeral 9 denotes a guide member (backup member), reference numeral 2 denotes the magnetic core, and reference numeral 3 denotes an energizing coil. The energizing coil 3 is spirally wound around the magnetic core 2. The fixing device 200 heat fixes an unfixed image onto the recording medium while nipping and conveying the recording medium carrying the unfixed image with a fixing nip portion N. Next, the details of the fixing device are described.

The film 1 includes an electrically conductive layer 1*a*, a rubber layer 1*b*, and a releasing layer 1*c*. The electrically conductive layer 1*a* is formed of a non-magnetic material, and specifically, formed of a material such as silver, aluminum, austenitic stainless steel, copper, or an alloy of one of these materials. The electrically conductive layer 1*a* can have a thickness of 20 to 75 μm. The rubber layer 1*b* and the releasing layer 1*c* are provided around the electrically conductive layer 1*a*. The rubber layer 1*b* and the releasing layer 1*c* are respectively formed of a material such as silicone rubber and a material such as fluoroplastic. The film 1 of the present embodiment has a diameter of 30 mm, and the electrically conductive layer 1*a* is formed of a 50 μm thick aluminum. The rubber layer 1*b* is a 300 μm thick silicone rubber, and the releasing layer 1*c* is a 30 μm thick tetrafluoroethylene-perfluoroalkyl vinyl ether copolymer (PFA) tube. The rubber layer 1*b* may be omitted.

The backup member 9, which is in contact with an inner surface of the fixing film 1 so as to back up the fixing film 1 from inside also has the function of guiding the film. In the present embodiment, the backup member is referred to as the guide member. The guide member 9 is formed of a heat resistant resin such as polyphenylene-sulfide (PPS) or liquid crystal polymer (LCP). A slide layer (slide member) formed of a 0.2 to 1.0 mm thick non-magnetic metal or a resin such as PFA or polyimide may be provided on a surface of the guide member 9 in contact with the fixing film 1. In the present embodiment, the guide member 9 is formed of PPS, and a slide member 6 that includes a PFA coated aluminum plate is attached to the guide member 9 on the surface in contact with the fixing film 1.

The pressure roller 7, which is in contact with an outer surface of the fixing film 1, serves as the nip portion forming member that forms the fixing nip portion N together with the backup member 9 with the fixing film 1 interposed therebetween. The pressure roller 7 is formed of an aluminum cored bar of a ϕ19 mm, around which a 3 mm thick rubber layer formed of a silicone rubber or the like and a 30 μm thick PFA releasing layer are formed. The pressure roller 7 is rotatably supported by frames 10 of the fixing device 200 through bearings. The pressure roller 7 is rotated in a B direction in, for example, FIG. 2 by a motor provided in the image forming apparatus main body.

The stay 4, which reinforces the backup member 9, is a metal plate formed of a non-magnetic material. The stay 4 is in contact with a surface 9*c* of the backup member 9 provided on a side opposite to the surface of the backup member 9 in contact with the fixing film 1. Since the stay 4 is subjected to a large load E of about 100 to 500 N, the material of the stay 4 needs to have a high strength. Specifically, the stay 4 uses a metal plate formed of a non-magnetic metal such as aluminum, austenitic stainless steel, or an alloy of one of these materials. Furthermore, in order for the stay 4 to have a sufficient moment of inertia of area, the stay 4 is formed by bending a metal plate having a thickness of 1 to 3 mm so as to have a U-shaped section. In the present embodiment, a 1.5 mm thick austenitic stainless steel plate is bent to have a U-shaped section. A bottom portion 4*c* of the U-shape of the stay 4 is a flat portion, which is pressed against the surface 9*c* of the guide member 9. As illustrated in FIG. 5A, a contact width PR, by which the bottom portion 4*c* of stay 4 is in contact with the surface 9*c* of the guide member 9, is larger than the width of the fixing nip portion N.

Flanges (regulating member) 5 are attached to both ends of the stay 4 so as to regulate sliding of the film 1 in a generatrix direction. The sliding of film 1 is regulated by regulating surfaces 5*a* of the flanges 5. The flanges 5 are slid to be attached at openings of the frames 10 of the fixing device 200. The load (pressure) E for forming the fixing nip portion N is applied to two flanges 5, the stay 4, the guide member 9, the slide member 6, the film 1, the pressure roller 7, and the frames 10 in this order.

A spirally shaped portion, a spiral axis of which is substantially parallel to the generatrix direction of the fixing film 1, is provided in the inside (recess portion of U-shape) of the stay 4. The spirally shaped portion includes the energizing coil 3 that forms an alternating magnetic field so as to cause the electrically conductive layer 1*a* to generate heat due to electromagnetic induction. The spirally shaped portion also includes the core 2 for directing lines of magnetic force of the alternating magnetic field therein. A current flowing in a circumferential direction of the film 1 is induced in the electrically conductive layer 1*a* by the alternating magnetic field formed by causing a high-frequency current to flow through the coil 3. Thus, the entirety of the electrically conductive layer 1*a* generates heat in the circumferential direction of the fixing film 1.

The coil 3 uses a litz wire or the like, which is formed by stranding thin wires, and is wound 10 to 100 turns around the core 2 at specified intervals. In the present embodiment, the coil 3 is wound 16 turns.

The magnetic core 2 is a ferromagnetic body formed of, for example, an alloy material or an oxide having a high permeability such as sintered ferrite, ferrite resin, an amorphous alloy, or a permalloy. The sectional area of the core 2 can be increased as much as possible as long as the core 2 can be accommodated in the film 1. The shape of the core 2 is not limited to a columnar shape. The core 2 may have a shape such as a prism shape. In the present embodiment, the core 2 uses a sintered ferrite having a columnar shape of ϕ14 mm. The core 2 and the coil 3 are electrical insulated from each other by an insulating member interposed therebetween.

The core 2 and the coil 3 wound around the core 2 are accommodated in a cover 8*a* and a cover 8*b*. The coil 3 and the core 2 accommodated in the cover 8*a* and the cover 8*b* (may be referred to as a coil unit 8U hereafter) are inserted into the recess portion of the stay 4 and held by the stay 4. A plurality of ribs 8*b*1 are provided at positions of the cover 8*b* opposite leg portions 4*a* of the U-shape of the stay 4. Furthermore, A rib 8*b*2 is provided at a position of the cover 8*b* opposite the bottom portion 4*c* of the U-shape of the stay 4. The ribs 8*b*1 and the rib 8*b*2 are in contact with an inner surface of the stay 4, thereby determining the position of the coil unit 8U in the recess portion of the stay 4. Furthermore, although the coil unit 8U is disposed in (the recess portion of) the stay 4, the load E is not applied to these components.

As illustrated in FIG. 2, end portions of the coil unit 8U, which is held by the stay 4, project outward in the film generatrix direction from the regulating surfaces 5*a* of the flanges 5, which regulate the sliding of the film 1. The core 2 and coil 3 of the coil unit 8U also projects outward from the regulating surfaces 5*a*.

A thermistor (temperature detection element) 240, which detects the temperature of the film 1, is in elastic contact with the inner surface of the film 1. A holding member 240*a*, which hold the thermistor 240, has a hole, into which a boss 8*b*3 provided on the cover 8*b* is engaged. Thus, the thermistor 240 is held by the cover 8*b*. Power supplied to the coil 3 is controlled in accordance with the temperature detected by the temperature detecting element 240.

As described above, in order to increase the width (length in a recording medium conveying direction) of the fixing nip portion N, the width (length in the recording medium conveying direction) of the backup member 9 also needs to be increased. Furthermore, in order to suppress bending of the backup member 9 even when the load E is applied to the backup member 9 having a large width, the width (length in the recording medium conveying direction) of the bottom portion 4*c* of the stay 4 needs to be increased. Thus, a region Ln (see FIG. 5A) of a circumferential length La of the film 1, the region Ln being positioned on the pressure roller side relative to the bottom portion 4*c* of the stay 4, is allocated as a region that is needed to form the fixing nip portion N. Thus, in the case of the fixing device in which heat is radiated from the inside of the cylinder of the film by a halogen heater, a region of the film subjected to heat is reduced. This is a drawback when warming up the film. The region of the film subjected to heat may be increased by increasing the circumferential length of the film. However, with this measure, the heat capacity of the film is increased, and accordingly, advantages obtained by using the film are reduced and an increase in size of the device cannot be suppressed.

In view of the above-described situation, in the present embodiment, the electrically conductive layer 1*a* is provided, and the coil unit 8U is provided in the film 1. The coil unit 8U includes the core 2 and the coil 3, the spiral axis of which is substantially parallel to the generatrix direction of the film 1. By causing a high-frequency current to flow through the coil 3, most of the magnetic flux exiting through both the ends of the core 2 passes through outside the electrically conductive layer 1*a*, thereby an induced current flows through the electrically conductive layer 1*a* in the circumferential direction. Thus, the film 1 generates heat entirely in the film circumferential direction, and accordingly, a time period required to warm up can be reduced even when the width of the fixing nip portion N is increased.

Next, the layout of the components disposed in the fixing device 200 of the present embodiment is described in detail below. As described above, the fixing device 200 of the present embodiment is an induction heating fixing device, in which the alternating magnetic field (magnetic flux) is formed by causing a high-frequency alternating current to flow through the coil 3, and a current is induced in the electrically conductive layer 1*a* of the film 1 so as to form a magnetic flux, which cancels out the magnetic flux formed by the flow of the alternating current. However, in order for the induced current to flow in the circumferential direction of the electrically conductive layer 1*a* (that is, in order for the current to flow entirely in the circumferential direction of the electrically conductive layer 1*a*), most of the magnetic flux passing through the inside of the core 2 and exiting the core 2 through the end portions of the core 2 forms a magnetic flux passing through the outside of the electrically conductive layer 1*a* (outside of the cylinder).

In order to form such an alternating magnetic field, the ratio of the diameter of the core 2 to the diameter of the film 1 (electrically conductive layer 1*a*) needs to be increased. That is, in the section of the fixing device 200 illustrated in FIG. 3A, the ratio of the area of the core 2 to the area inside the cylinder of the film 1 is determined. Furthermore, in order to reduce the temperature required for fixing a toner image, the width of the fixing nip portion N needs to be increased. Thus, the pressure (load E) required to form the desired width of the fixing nip portion N and the width of the bottom portion 4*c* of the stay 4 are determined.

Figure 5B:
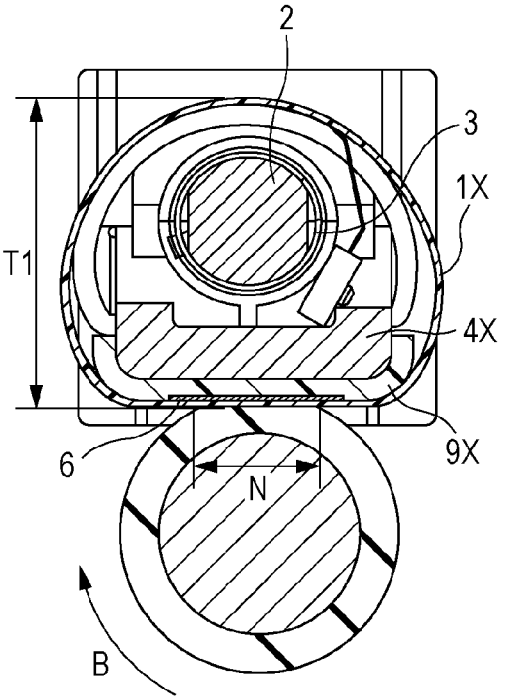

Also, the moment of inertia of area of the stay 4 to endure the load E is determined. However, there may be a variety of shapes of the stay 4 for obtaining the desired moment of inertia of area. Thus, the device configuration, with which an increase in diameter of the film can be suppressed, the core having a specified sectional area can be accommodated, and the fixing nip portion having a specified width can be formed, has been studied. FIG. 5A is a sectional view of the fixing device of the present embodiment, and FIG. 5B is a sectional view of a fixing device of a comparative example. The materials and the moments of inertia of area of the stay 4 illustrated in FIG. 5A and the stay 4X illustrated in FIG. 5B are the same. Furthermore, both the contact width, by which the stay 4 and the guide member 9 illustrated in FIG. 5A are in contact with each other, and the contact width, by which the stay 4X and the guide member 9X illustrated in FIG. 5B are in contact with each other, are PR, that is, the same.

As can be seen by comparing FIGS. 5A and 5B, the diameter of the film perpendicular to the fixing nip portion is T for the film 1 and T1 (T1>T) for a film 1X. Also, the circumference of the film is smaller in FIG. 5A than that in FIG. 5B. These differences are caused by the difference in the sectional shape between the stays. In the device illustrated in FIG. 5A, the core 2 is located in a region U inside (recess portion) the stay 4 having the U-shaped section, and accordingly, the diameter T is small. In the device illustrated in FIG. 5B, the core 2 is not located in the inside of the stay 4X having the U-shaped section. Thus, the diameters of the films perpendicular to the fixing nip portions are different from each other between both the devices. This causes a difference in size of the devices.

Thus, in the device of the present embodiment, the core is located in the region U surrounded by the bottom portion 4*c* and the two leg portions 4*a* of the U-shaped stay in the section of the device seen from one end in the film generatrix direction. With this configuration, the increase in size of the device is suppressed.

Figure 5C:
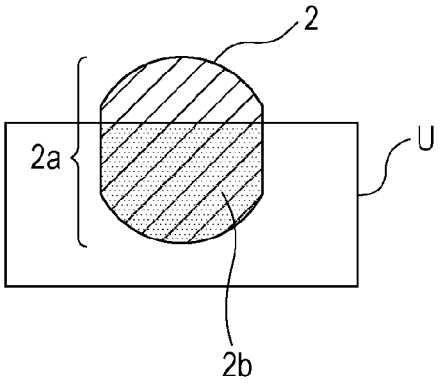

Next, the layout of the device for further desirably suppressing the increase in size of the device is described with reference to FIGS. 5A to 5C. Table 1 lists the results of comparisons of three devices, the shapes of the stays of which are different from one another. These comparisons are made on the assumption that the strengths of the stays are constant and the lengths PR of the bottom portions of the stays are constant. Parameters for the comparisons include a height 4H of bent portions of the stay 4, a thickness 4T of the stay 4, the ratio of a sectional area 2*b* of the core, the sectional area 2*b* being located in the region U, to the entire sectional area 2*a* of the core (2*b*/2*a*), the ratio of the sectional area 2*b* of the core to the area of the region U (2*b*/U).

TABLE 1

| | First device | Second device | Third device |
|---|---|---|---|
| Stay height 4H (in mm) | 13 | 8 | 5 |
| Stay thickness 4T (in mm) | 1.5 | 2.1 | 3 |
| Area ratio (2b/2a) [%] | 64 | 20 | 0.4 |
| Area ratio (2b/U) [%] | 28 | 20 | 2 |

As a result of the study, in order to obtain the specified moment of inertia of area, the thickness 4T of the stay 4 needs to be increased when the height 4H of the stay 4 is reduced as is the case with the third device. As a result, both the area ratios 2*b*/2*a* and 2*b*/U are reduced and the height T is increased. Also, the amount of metal sheets having a thickness of more than 2.3 mm in the market is small, and accordingly, the cost is increased. Thus, in order to reduce the size of the device, the area ratio 2*b*/2*a* is preferably equal to or more than 20% as is the case with the first or second device. Furthermore, the area ratio 2*b*/U is preferably equal to or more than 20%. Furthermore, a length Ln of the film on the fixing nip portion side relative to a virtual plane drawn by extending the flat portion of the stay is preferably equal to or more than 20% of the length La of the fixing film 1 in the circumferential direction.

Next, a configuration desirable for causing the induced current to flow entirely in the circumferential direction of the film is described.

(1) Heat Generating Mechanism of Fixing Device of Present Embodiment

Figure 6A:
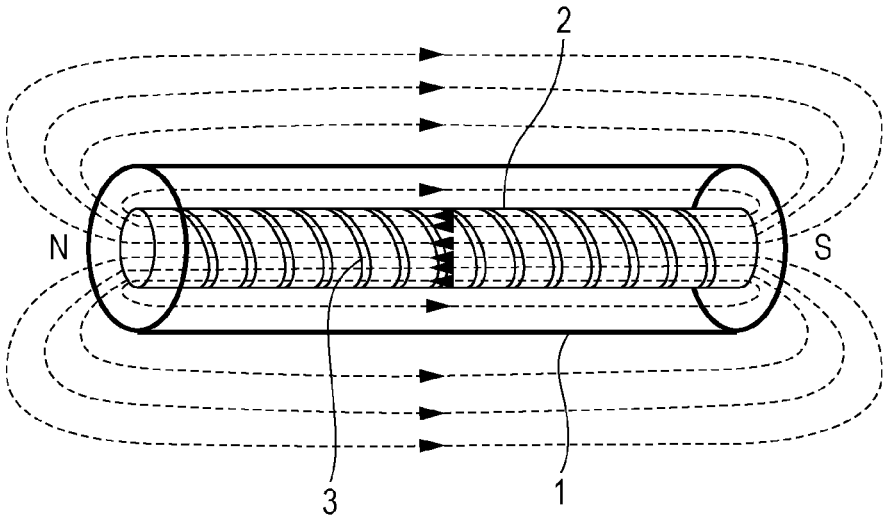
FIGS. 6A and 6B are explanatory views of a heat generation mechanism of the fixing device.

Referring to FIG. 6A, a heat generating mechanism of the fixing device of the present embodiment is described. The lines of magnetic force generated by causing the alternating current to flow through the coil 3 pass through the inside of the magnetic core 2 in the generatrix direction of the electrically conductive layer 1*a* (direction from south pole to north pole), exit the magnetic core 2 through one end (north pole) to the outside of the electrically conductive layer 1*a*, and return to the magnetic core 2 through another end (south pole). An induced electromotive force is generated in the electrically conductive layer 1*a* so as to form a magnetic flux that cancels out a magnetic flux formed by the coil 3, and a current is induced in the circumferential direction of the electrically conductive layer 1*a*. Joule heat due to the induced current causes the electrically conductive layer 1*a* to generate heat. The magnitude of the induced electromotive force V generated in the electrically conductive layer 1*a* is, as given in equation (1) below, proportional to the amount of change in the magnetic flux passing through the inside of the electrically conductive layer 1*a* per unit time ($\Delta\phi/\Delta t$) and the number of turns N of the coil 3.

$$V = -\frac{N\Delta\Phi}{\Delta t} \quad (1)$$

Figure 6B:
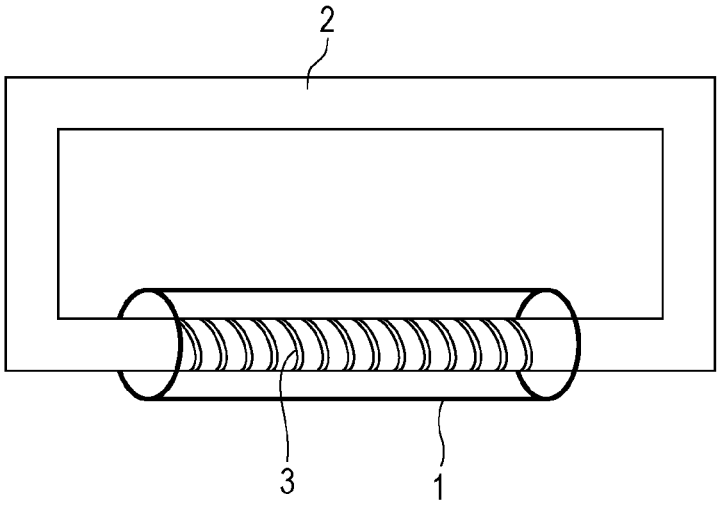

(2) Relationship Between Ratio of Magnetic Flux Passing Outside Electrically Conductive Layer and Power Conversion Efficiency The magnetic core 2 illustrated in FIG. 6A does not have a loop shape but has the end portions. When the magnetic core 2 has a loop shape outside the electrically conductive layer 1*a* as illustrated in FIG. 6B in the fixing device, the lines of magnetic force are directed by the magnetic core so that the lines of magnetic force exit the inside of the electrically conductive layer 1*a* to the outside and then return to the inside of the electrically conductive layer 1*a*. However, when the magnetic core 2 has the end portions as in the present embodiment, the lines of magnetic force having exited the magnetic core 2 through the end portions of the magnetic core 2 are not directed. Thus, the lines of magnetic force having exited the magnetic core 2 through one end portion of the magnetic core 2 return to another end of the magnetic core 2 (from the north pole to the south pole) through an outside route, which extends outside the electrically conductive layer 1*a*, and an inside route, which extends inside the electrically conductive layer 1*a*. Hereafter, the outside route refers to the route extending from the north pole to the south pole of the magnetic core 2 outside the electrically conductive layer 1*a*, and the inside route refers to the route extending from the north pole to the south pole of the magnetic core 2 through the inside of the electrically conductive layer 1*a*.

The ratio of the lines of magnetic force passing through the outside route to the lines of magnetic force having exited through the one end of the magnetic core 2 is correlated to power consumed for generating heat (power conversion efficiency) by the electrically conductive layer 1*a* among the power input to the coil 3 and an important parameter. As the ratio of the lines of magnetic force passing through the outside route increases, the ratio of the power consumed for generating heat (power conversion efficiency) by the electrically conductive layer 1*a* to the power input to the coil 3 increases. The reason for this is similarly explained by a principle in which, when leakage flux is sufficiently small in a transformer and the numbers of the lines of magnetic force passing through the primary winding and the secondary winding of the transformer are equal to each other, the power conversion efficiency increases. That is, when the difference between the numbers of the lines of magnetic force passing through inside the magnetic core and outside the magnetic core reduces, the power conversion efficiency increases, and accordingly, magnetic induction can be effectively performed with the high-frequency current flowing through the coil as a circulating current J in the electrically conductive layer.

Referring to FIG. 6A, the direction of the lines of magnetic force directed from the south pole to the north pole inside the core is opposite to the direction of the lines of magnetic force passing through the inside route. Thus, these lines of magnetic force passing through the inside the core and the inside route cancel out one another. As a result, the number of the lines of magnetic force (magnetic flux) passing through the entirety of the inside of the electrically conductive layer 1*a* from the south pole to the north pole reduces, and accordingly, the amount of change in the magnetic flux per unit time reduces. When the amount of change in the magnetic flux per unit time reduces, the induced electromotive force generated in the electrically conductive layer 1*a* reduces, thereby reducing the amount of heat generated by the electrically conductive layer 1*a*.

Accordingly, in order to improve the power conversion efficiency, it is important to control the ratio of the lines of magnetic force passing through the outside route.

(3) Index Indicating Ratio of Magnetic Flux Passing Outside Electrically Conductive Layer The ratio of the lines of magnetic force passing through the outside route is represented by an index referred to as permeance that indicates the degree of ease at which the lines of magnetic force pass. Initially, a general concept of magnetic circuitry is described. A circuit of a magnetic path through which the lines of magnetic force pass is referred to as a magnetic circuit similarly to an electric circuit, through which electricity passes. The magnetic flux in the magnetic circuit can be calculated similarly to calculation of current in the electric circuit. The Ohm's law regarding to the electric circuit is applicable to the magnetic circuit. When a magnetic flux, which corresponds to a current in the electric circuit, is Φ, a magnetomotive force, which corresponds to an electromotive force in the electric circuit, is V, and reluctance, which corresponds to resistance in the electric circuit, is R, the following equation (2) is satisfied:

$$\Phi = V/R \quad (2).$$

Here, for ease of understanding of the principle, permeance P, which is the reciprocal of reluctance R, is used in the description. When using permeance P, the above-described equation (2) can be expressed by, for example, the following equation (3):

$$\Phi = V \times P \quad (3).$$

Furthermore, when the length of a magnetic path is B, the sectional area of the magnetic path is S, and the permeability of the magnetic path is μ, permeance P can be expressed by, for example, the following equation (4):

$$P = \mu \times S/B \quad (4).$$

Permeance P is proportional to the sectional area S and permeability μ and inversely proportional to the length B of the magnetic path.

Figure 7A:
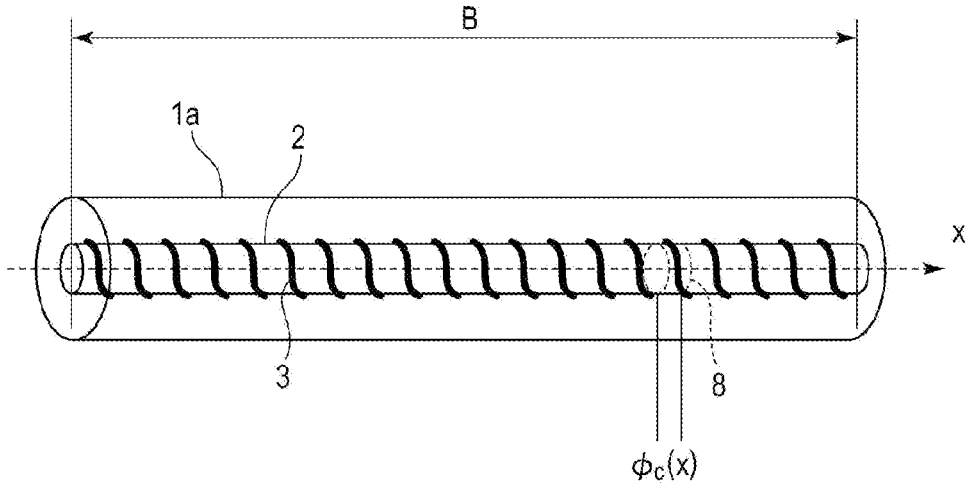
FIGS. 7A and 7B are schematic views of a structure in which a finite length solenoid is disposed.
Figure 7B:
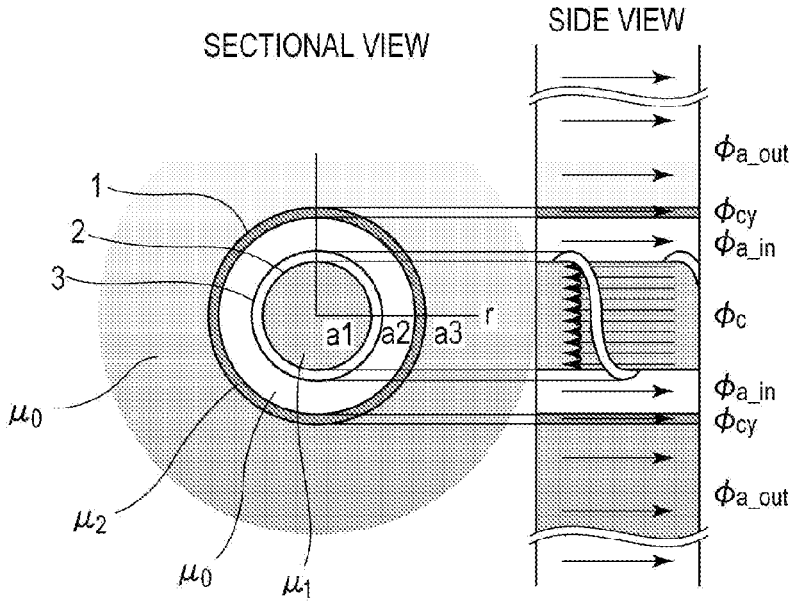

FIG. 7A illustrates a structure in which the coil 3 is wound N times around the magnetic core 2, which has a radius of $a_1$ m, a length of B m, and a relative permeability of $\mu_1$, such that the spiral axis of the coil 3 is substantially parallel to the generatrix direction of the electrically conductive layer 1*a* inside the electrically conductive layer 1*a*. Here, the electrically conductive layer 1*a* is a conductor having a length of B m, an inner diameter of $a_2$ m, an outer diameter of $a_3$ m, and a relative permeability of $\mu_2$. The permeability of vacuum inside and outside the electrically conductive layer 1*a* is $\mu_0$ H/m. When a current of I A flows through the coil 3, a magnetic flux 8 generated per unit length of the magnetic core 2 is $\phi_c(x)$. FIG. 7B is a sectional view perpendicular to a longitudinal direction of the magnetic core 2. Arrows in FIG. 7B indicate magnetic fluxes, which pass through the inside of the magnetic core 2, the inside of the electrically conductive layer 1*a*, and the outside of the electrically conductive layer 1*a* and are parallel to the longitudinal direction of the magnetic core 2 when the current I flows through the coil 3. The magnetic flux passing through the inside of the magnetic core 2 is $\phi_c$ ($=\phi_c(x)$), the magnetic flux passing through the inside of the electrically conductive layer 1*a* (region between the electrically conductive layer 1*a* and the magnetic core 2) is $\phi_{a_in}$, the magnetic flux passing through the electrically conductive layer 1*a* itself is $\phi_s$, and the magnetic flux passing through the outside of the electrically conductive layer 1*a* is $\phi_{a_out}$.

Figure 8A:
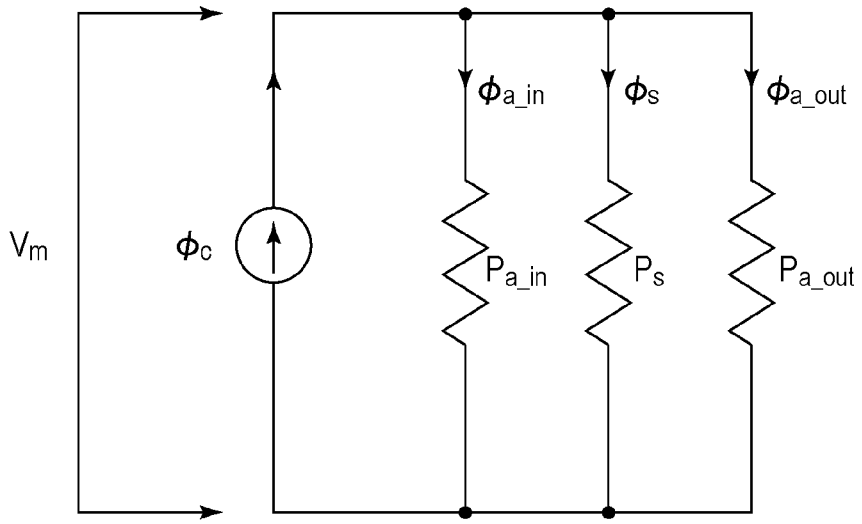
FIGS. 8A and 8B illustrate a magnetically equivalent circuit of a space including a core, a coil, and a cylindrical member per unit length.
Figure 8B:
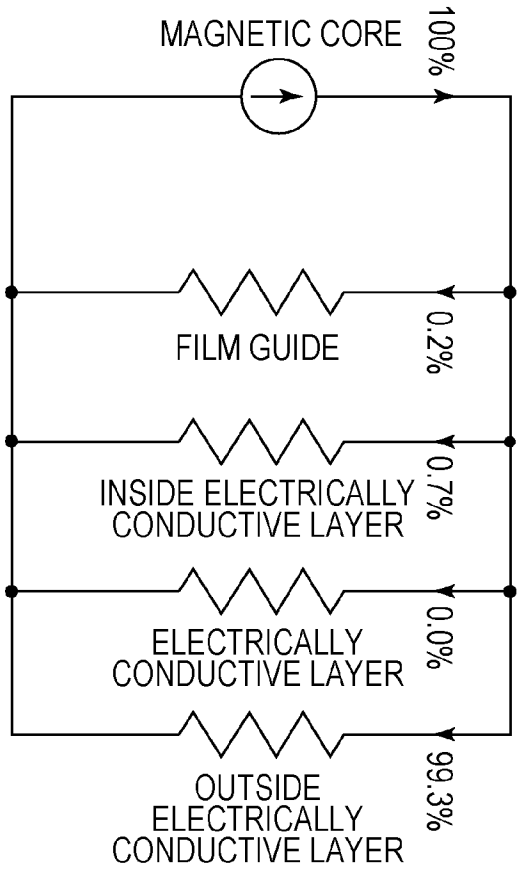

FIG. 8A is a magnetically equivalent circuit of a space per unit length illustrated in FIG. 6A including the core 2, the coil 3, and the electrically conductive layer 1*a*. $V_m$ represents a magnetomotive force generated by the magnetic flux $\phi_c$ passing through the magnetic core 2, $P_c$ represents permeance of the magnetic core 2, $P_{a_in}$ represents permeance inside the electrically conductive layer 1*a*, $P_s$ represents permeance inside the electrically conductive layer 1*a* itself of the film, and $P_{a_out}$ represents permeance outside the electrically conductive layer 1*a*.

Here, it is thought that, when $P_c$ is sufficiently larger than $P_{a_in}$ and $P_s$, the magnetic flux having passed through the inside of the magnetic core 2 and exited the magnetic core 2 through the one end of the magnetic core 2 returns to the other end of the magnetic core 2 through one of $\phi_{a_in}$, $\phi_s$, and $\phi_{a_out}$. Thus, the following relationship (5) holds:

$$\phi_c=\phi_{a_in}+\phi_s+\phi_{a_out} \tag{5}$$

Also, $\phi_c$, $\phi_s$, $\phi_{a_in}$, and $\phi_{a_out}$ are respectively expressed by the following equations (6) to (9):

$$\phi_c=P_c\times V_m \tag{6}$$

$$\phi_s=P_s\times V_m \tag{7}$$

$$\phi_{a_in}=P_{a_in}\times V_m \tag{8}$$

$$\phi_{a_out}=P_{a_out}\cdot V_m \tag{9}$$

Thus, by substituting equations (6) to (9) to equation (5), $P_{a_out}$ is expressed by, for example, the following equation (10):

$$\begin{aligned} P_{a_out} &= P_c - P_{a_in} - P_s \\ &= \mu_1\cdot S_c - \mu_0\cdot S_{a_in} - \mu_2\cdot S_s \\ &= \pi\cdot\mu_1\cdot(a_1)^2 - \\ &\quad \pi\cdot\mu_0\cdot((a_2)^2-(a_1)^2) - \\ &\quad \pi\cdot\mu_2\cdot((a_3)^2-(a_2)^2). \end{aligned} \tag{14}$$

From FIG. 7B, when the sectional area of the magnetic core 2 is $S_c$, the sectional area inside the electrically conductive layer 1*a* is $S_{a_in}$, and the sectional area of the electrically conductive layer 1*a* itself is $S_s$, permeance can be expressed by "permeability×sectional area" as follows. In this case, the unit is H·m.

$$P_c=\mu_1\cdot S_c=\mu_1\cdot\pi(a_1)^2 \tag{11}$$

$$P_{a_in}=\mu_0\cdot S_{a_in}=\mu_0\cdot\pi\cdot((a_2)^2-(a_1)^2) \tag{12}$$

$$P_s=\mu_2\cdot S_s=\mu_2\cdot\pi\cdot((a_3)^2-(a_2)^2) \tag{13}$$

By substituting these equations (11) to (13) into equation (10), $P_{a_out}$ can be expressed by the equation (14):

$$\begin{aligned} P_c\times V_m &= P_{a_in}\times V_m + P_s\times V_m + P_{a_out}\times V_m = \\ &(P_{a_in}+P_s+P_{a_out})\times V_m \therefore P_{a_out} = P_c - P_{a_in} - P_s. \end{aligned} \tag{10}$$

The ratio of the lines of magnetic force $P_{a_out}/P_c$ passing through the outside of the electrically conductive layer 1*a* can be calculated with the above-described equation (14).

Reluctance R may be used instead of permeance P. When discussing with reluctance R, since reluctance R is simply the reciprocal of permeance P, reluctance R per unit length can be expressed by "1/(permeability×sectional are)". In this case, the unit is 1/(H·m).

Results of calculation of permeance and reluctance with specific parameters are listed in Table 2 below.

TABLE 2

| | Unit | Magnetic core | Film guide | Inside electrically conductive layer | Electrically conductive layer | Outside electrically conductive layer |
|---|---|---|---|---|---|---|
| Sectional area | m^2 | 1.5E−04 | 1.0E−04 | 2.0E−04 | 1.5E−06 | |
| Relative permeability | | 1800 | 1 | 1 | 1 | |
| Permeability | H/m | 2.3E−3 | 1.3E−6 | 1.3E−6 | 1.3E−6 | |
| Permeance per unit length | H · m | 3.5E−07 | 1.3E−10 | 2.5E−10 | 1.9E−12 | 3.5E−07 |
| Reluctance per unit length | 1/(H · m) | 2.9E+06 | 8.0E+09 | 4.0E+09 | 5.3E+11 | 2.9E+06 |
| Ratio of magnetic flux | % | 100.0% | 0.0% | 0.1% | 0.0% | 99.9% |

The magnetic core 2 is formed of ferrite (relative permeability is 1800). The diameter and the sectional area of the magnetic core 2 are respectively 14 mm and $1.5\times10^{-4}$ $m^2$. The backup member 9 (film guide), which backs up the fixing film 1 from inside for forming the fixing nip portion N is formed of PPS (relative permeability is 1.0). The sectional area of the backup member 9 is $1.0\times10^{-4}$ $m^2$. The electrically conductive layer 1*a* is formed of aluminum (relative permeability is 1.0). The diameter, the thickness, and the sectional area of the electrically conductive layer 1*a* are respectively 24 mm, 20 μm, and $1.5\times10^{-6}$ $m^2$.

The sectional area of the region between the electrically conductive layer 1*a* and the magnetic core 2 is calculated by subtracting the sectional areas of the magnetic core 2 and the film guide from the sectional area of a hollow inside the electrically conductive layer 1*a* having a diameter of 24 mm. According to Table 2, the values of $P_c$, $P_{a_in}$, and $P_s$ are as follows:

$$P_c=3.5\times10^{-7}\ H\cdot m$$

$$P_{a_in}=1.3\times10^{-10}+2.5\times10^{-10}\ H\cdot m$$

$$P_s=1.9\times10^{-12}\ H\cdot m.$$

With these values, $P_{a_out}/P_c$ can be calculated by using the following equation (15):

$$P_{a_out}/P_c=(P_c-P_{a_in}-P_s)/P_c=0.999(99.9\%) \quad (15).$$

The magnetic core 2 may be divided into a plurality of pieces in the longitudinal direction with gaps formed between the divided pieces of the magnetic core 2. In this case, when the gaps are filled with air, a substance, the relative permeability of which is regarded to be 1.0, or a substance, the relative permeability of which is significantly smaller than that of the magnetic core 2, the reluctance R of the entire magnetic core 2 is increased. This degrades the function of directing the lines of magnetic force.

A calculation method of permeance of such a divided magnetic core 2 is complex. The calculation method of permeance of the entire magnetic core 2 for the following case will be described: that is, the magnetic core 2 is divided into a plurality of pieces, which are arranged at regular intervals with the gaps or sheet-shaped non-magnetic members interposed therebetween. In this case, it is required that reluctance of the entirety in the longitudinal direction be derived, the reluctance be divided by the total length so as to obtain reluctance per unit length, and the reciprocal of the reluctance per unit length be used to obtain permeance per unit length.

Figure 9:
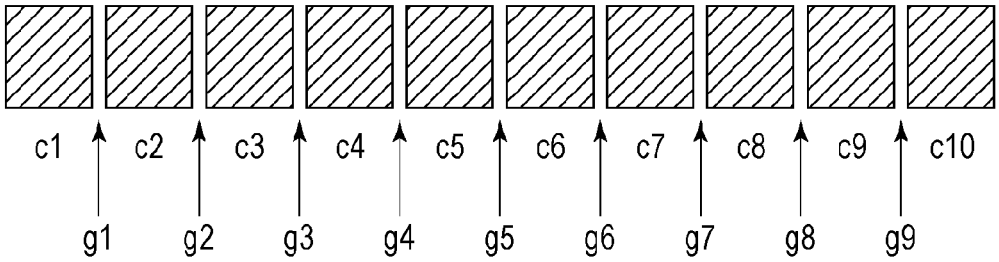
FIG. 9 is a schematic view of magnetic cores and gaps.

Initially, FIG. 9 is a block diagram of a magnetic core in the longitudinal direction. The magnetic core is divided into pieces of the magnetic cores c1 to c10 with gaps g1 to g9 formed therebetween. The sectional area, permeability, and the width of each of the divided pieces of the core are respectively $S_c$, $\mu_c$, and $L_c$. The sectional area, permeability, and the width of each of the gaps g1 to g9 are respectively $S_g$, $\mu_g$, and $L_g$. Total reluctance $R_{m_all}$ of all the pieces of the magnetic core arranged in the longitudinal direction is given by the following equation (16):

$$R_{m_all}=(R_{m_c1}+R_{m_c2}+\ldots+R_{m_c10})+(R_{m_g1}+R_{m_g2}+\ldots+R_{m_g9}) \quad (16).$$

Since the shapes and materials of the pieces of the magnetic core and the gap widths are uniform in this core arrangement, when $\Sigma_{Rm_c}$ is the sum of $R_{m_c}$s and $\Sigma R_{m_g}$ is the sum of $R_{m_g}$s, the relationships expressed by, for example, the following equations (17) to (19) can hold:

$$R_{m_all}=(\Sigma R_{m_c})+(\Sigma R_{m_g}) \quad (17)$$

$$R_{m_c}=L_c/(\mu_c \cdot S_c) \quad (18)$$

$$R_{m_g}=L_g/(\mu_g \cdot S_g) \quad (19).$$

By substituting equations (18) and (19) into equation (17), the total reluctance $R_{m_all}$ in the longitudinal direction can be expressed by, for example, the following equation (20):

$$\begin{aligned} R_{m_all} &= (\Sigma R_{m_c}) + (\Sigma R_{m_g}) \\ &= (L_c/(\mu_c \cdot S_c)) \times 10 + (L_g/(\mu_g \cdot S_g)) \times 9. \end{aligned} \quad (20)$$

Here, reluctance $R_m$ per unit length is, when the sum of $L_c$s is $\Sigma L_c$ and the sum of $L_g$s is $\Sigma L_g$, expressed by the following equation (21):

$$\begin{aligned} R_m &= R_{m_all}/(\Sigma L_c + \Sigma L_g) \\ &= R_{m_all}/(L \times 10 + L_g \times 9). \end{aligned} \quad (21)$$

Thus, permeance $P_m$ per unit length can be obtained by the following equation (22):

$$\begin{aligned} P_m &= 1/R_m \\ &= (\Sigma L_c + \Sigma L_g)/R_{m_all} \\ &= (\Sigma L_c + \Sigma L_g)/[\{\Sigma L_c/(\mu_c \cdot S_c)\} + (\Sigma L_g/(\mu_g \cdot S_g))]. \end{aligned} \quad (22)$$

An increase in the width of the gap $L_g$ leads to an increase in the reluctance of the magnetic core 2 (reduction in permeance). Regarding the principle of heat generation, in the configuration of the fixing device of the present embodiment, it is desirable that the magnetic core 2 have a low reluctance (high permeance) in the design, and accordingly, the formation of the gaps is less desirable. Despite this, in order to prevent breakage of the magnetic core 2, the magnetic core 2 may be divided into a plurality of pieces with the gaps formed therebetween.

As described above, the ratio of the lines of magnetic force passing through the outside route can be expressed with permeance or reluctance.

(4) Power Conversion Efficiency Required for Fixing Device

Next, power conversion efficiency required for the fixing device of the present embodiment is described. Assuming that power conversion efficiency is, for example, 80%, the remaining 20% of the power is converted into thermal energy and consumed by the coil or core other than the electrically conductive layer. When the power conversion efficiency is low, components not required to generate heat such as a magnetic core and coil generate heat. Thus, a measure to cool these components may be required.

In the present embodiment, when the electrically conductive layer is caused to generate heat, a high-frequency alternating current is caused to flow through the energizing coil to form an alternating magnetic field. This alternating magnetic field induces a current in the electrically conductive layer. The physical model of this is very similar to that of magnetic coupling of a transformer. Thus, when discussing power conversion efficiency, an equivalent circuit of magnetic coupling of the transformer can be used. The energizing coil and the electrically conductive layer are magnetically coupled to each other by the alternating magnetic field, thereby the power input to the energizing coil is transferred to the electrically conductive layer. Herein, "power conversion efficiency" is the ratio of the power consumed by the electrically conductive layer to the power input to the energizing coil serving as a magnetic field forming device. In the present embodiment, power conversion efficiency is the ratio of the power consumed by the electrically conductive layer 1*a* to the power input to the energizing coil 3. This power conversion efficiency can be expressed by the following equation (23):

Power conversion efficiency=power consumed by electrically conductive layer/power supplied to energizing coil (23).

Examples of the power supplied to the energizing coil and consumed by components other than the energizing coil include a loss due to resistance of the energizing coil and a loss due to magnetic characteristics of the material of the magnetic coil.

Figure 10A:
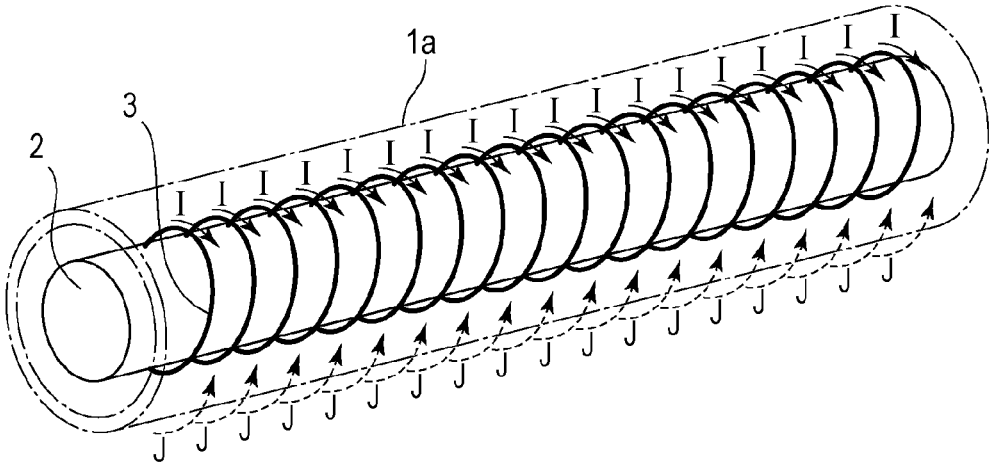
FIGS. 10A and 10B are explanatory views of efficiency of a circuit.
Figure 10B:
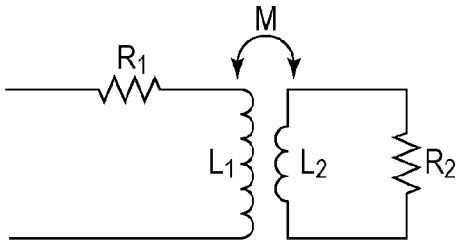

FIGS. 10A and 10B are explanatory views of efficiency of a circuit. In FIG. 10A, the electrically conductive layer 1*a*, the magnetic core 2, and the energizing coil 3 are illustrated. FIG. 10B is an equivalent circuit.

Figure 11A:
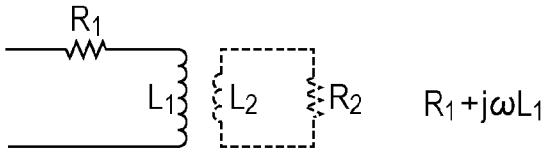
FIGS. 11A to 11C are explanatory views of the efficiency of the circuit.

$R_1$ corresponds to the loss in the energizing coil and the magnetic core, $L_1$ corresponds to the inductance of the energizing coil wound around the magnetic core, M corresponds to the mutual inductance between the winding and the electrically conductive layer, $L_2$ corresponds to the inductance of the electrically conductive layer, and $R_2$ corresponds to the resistance of the electrically conductive layer. An equivalent circuit without the electrically conductive layer is illustrated in FIG. 11A. When an equivalent series resistance $R_1$ from both ends of the energizing coil and equivalent inductance $L_1$ are measured with an impedance analyzer and an inductance/capacitance/resistance meter (LCR meter), the impedance $Z_A$ seen from both the end of the energizing coil can be expressed by, for example, equation (24):

$$Z_A = R_1 + j\omega L_1 \tag{24}$$

The current flowing through the circuit is lost by $R_1$. That is, $R_1$ represents the loss caused by the coil and the magnetic core.

Figure 11B:
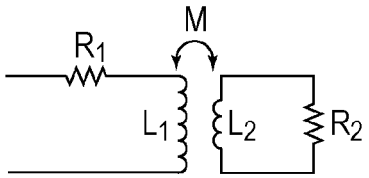
Figure 11C:
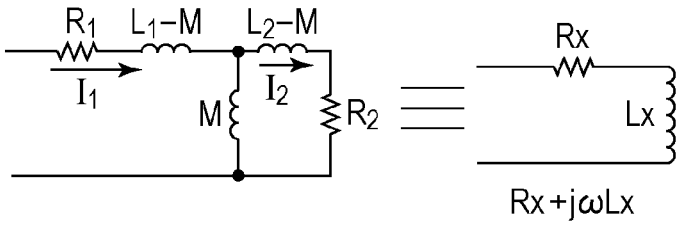

An equivalent circuit with the electrically conductive layer is illustrated in FIG. 11B. By measuring an equivalent series resistance Rx and Lx in this circuit with the electrically conductive layer, relationship (25) can be obtained through equivalent transformation as illustrated in FIG. 11C.

$$\begin{aligned} Z &= R_1 + j\omega(L_1 - M) + \frac{j\omega M(j\omega(L_2 - M) + R_2)}{j\omega M + j\omega(L_2 - M) + R_2} \\ &= R_1 + \frac{\omega^2 M^2 R_2}{R_2^2 + \omega^2 L_2^2} + j(\omega(L_1 - M) + \frac{M \cdot R_2^2 + \omega^2 M L_2 (L_2 - M)}{R_2^2 + \omega^2 L_2^2} \end{aligned} \tag{25}$$

$$Rx = R_1 + \frac{\omega^2 M^2 R_2}{R_2^2 + \omega^2 L_2^2} \tag{26}$$

$$Lx = \omega(L_1 - M) + \frac{M \cdot R_2^2 + \omega^2 M L_2 (L_2 - M)}{R_2^2 + \omega^2 L_2^2}\Bigg) \tag{27}$$

where M is the mutual inductance between the energizing coil and the electrically conductive layer.

As illustrated in FIG. 11C, when $I_1$ represents a current flowing through $R_1$ and $I_2$ represents a current flowing through $R_2$, equation (28) holds.

$$j\omega M(I_1 - I_2) = (R_2 + j\omega(L_2 - M))I_2 \tag{28}$$

Expression (29) can be derived from equation (28).

$$I_1 = \frac{R_2 + j\omega L_2}{j\omega M} I_2. \tag{29}$$

Efficiency (power conversion efficiency), which can be expressed as power consumption by resistance $R_2$/(power consumption by resistance $R_1$+power consumption by resistance $R_2$), can be expressed by, for example, equation (30):

$$\begin{aligned} \text{Power conversion efficiency} &= \frac{R_2 \times |I_2^2|}{R_1 \times |I_1^2| + R_2 \times |I_2^2|} \\ &= \frac{\omega^2 M^2 R_2}{\omega^2 L_2^2 R_1 + R_1 R_2^2 + \omega^2 M^2 R_2} \\ &= \frac{Rx - R_1}{Rx} \end{aligned} \tag{30}$$

By measuring the equivalent series resistance $R_1$ without the electrically conductive layer and the equivalent series resistance Rx with the electrically conductive layer, power conversion efficiency, which represents the ratio of power consumed by the electrically conductive layer to the power supplied to the energizing coil, can be obtained. In the present embodiment, the impedance analyzer 4294A from Agilent Technologies, Inc. is used for measurement of power conversion efficiency. Initially, the equivalent series resistance $R_1$ from both the ends of winding is measured without the fixing film. Then, the equivalent series resistance Rx from both the ends of winding is measured with the magnetic core inserted into the fixing film. As a result of the measurement, $R_1$=103 mΩ, and Rx=2.2Ω. With equation (30), power conversion efficiency at this time, 95.3%, can be obtained. Hereafter, the performance of the fixing device is evaluated in accordance with this power conversion efficiency.

Figure 12:
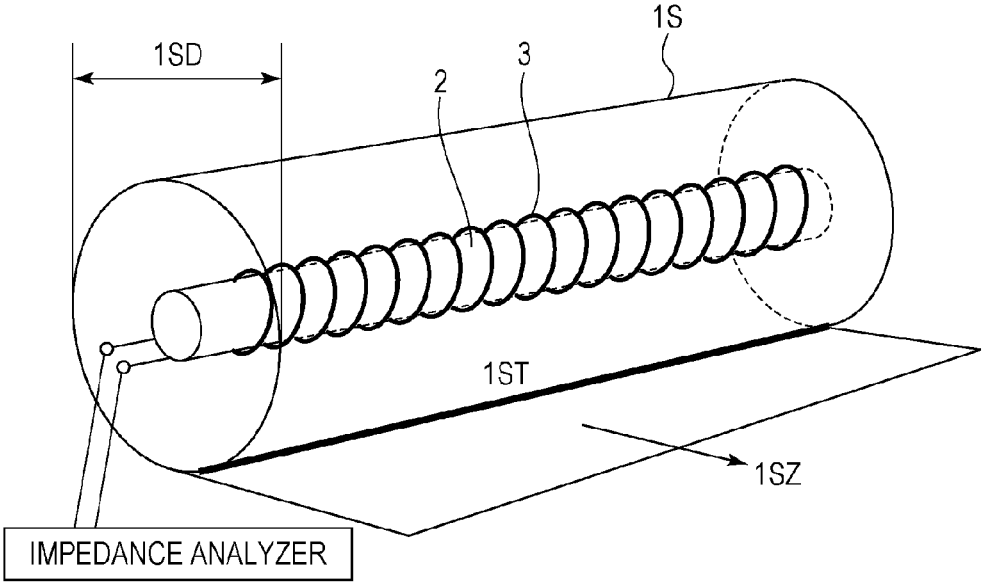
FIG. 12 illustrates an experimental device used in a measurement experiment of power conversion efficiency.

Here, power conversion efficiency required for the device is obtained. The power conversion efficiency is evaluated with respect to the ratio of the magnetic flux passing through the outside route of the electrically conductive layer 1*a*. FIG. 12 illustrates an experimental device used in a measurement experiment of power conversion efficiency. A metal sheet 1S is an aluminum sheet having a width of 230 mm, a length of 600 mm, and a thickness of 20 μm. The metal sheet 1S is rolled into a cylindrical shape so as to surround the magnetic core 2 and the coil 3. Electrical conduction is made at a portion represented by a bold line 1ST so that the metal sheet 1S serves as an electrically conductive layer. The magnetic core 2 having a columnar shape is formed of ferrite. The relative permeability and saturation flux density of the magnetic core 2 are respectively 1800 and 500 mT. The magnetic core 2 has a sectional area of 26 $mm^2$ and the length of 230 mm. The magnetic core 2 is disposed at the substantial center of the cylinder formed of the aluminum sheet 1S with a securing device (not illustrated). The coil 3 is spirally wound 25 turns around the magnetic core 2. By pulling an end portion of the metal sheet 1S in an arrow 1SZ direction, a diameter 1SD of the electrically conductive layer can be adjusted within a range of 18 to 191 mm.

Figure 13:
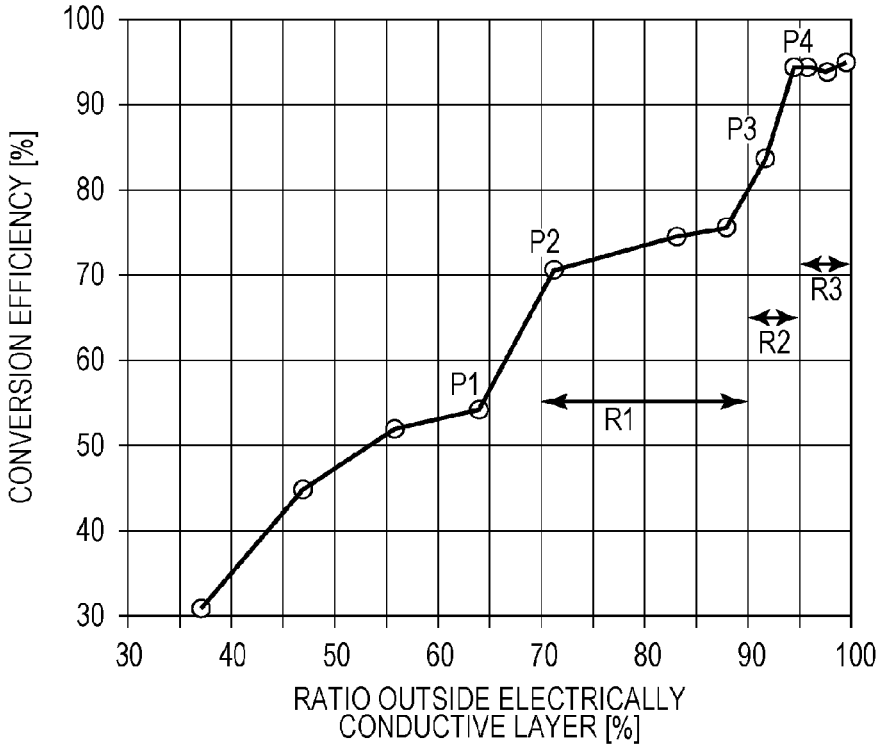
FIG. 13 illustrates the relationship between the ratio of the magnetic flux outside an electrically conductive rotating member and conversion efficiency.

FIG. 13 is a graph in which the horizontal axis represents the ratio in % of the magnetic flux passing through the outside route of the electrically conductive layer, and the vertical axis represents power conversion efficiency at the frequency of 21 kHz.

Referring to the graph in FIG. 13, the power conversion efficiency steeply increases from point P1 to a value more than 70%. In a range R1 indicated by a double-headed arrow, the power conversion efficiency is maintained at 70% or more. From a point near point P3, the power conversion efficiency steeply increases again and reaches to a value equal to or more than 80% near range R2. In a range R3 after P4, the power conversion efficiency is stabilized at a high value equal to or more than 94%. This steep increase in power conversion efficiency is caused due to starting of efficient flow of the circulating current J in the electrically conductive layer.

Table 3 below lists results, which are obtained by actually designing configurations corresponding to P1 to P4 in FIG. 13 as the fixing device and evaluated.

TABLE 3

| No. | Range | Diameter of electrically conductive layer (in mm) | Ratio of magnetic flux passing outside electrically conductive layer | Conversion efficiency [%] | Evaluation result (for high-performance fixing device) |
|---|---|---|---|---|---|
| P1 | — | 143.2 | 64.0 | 54.4 | Power may be insufficient. |
| P2 | R1 | 127.3 | 71.2 | 70.8 | Cooling device is desired. |
| P3 | R2 | 63.7 | 91.7 | 83.9 | Optimization of heat resistant design is desired. |
| P4 | R3 | 47.7 | 94.7 | 94.7 | Optimum configuration for flexible film. |

Fixing Device P1

In this configuration, the sectional area of the magnetic core is 26.5 $mm^2$ (5.75 mm×4.5 mm), the diameter of the electrically conductive layer is 143.2 mm, and the ratio of the magnetic flux passing through the outside route is 64%. Power conversion efficiency of this device obtained with the impedance analyzer is 54.4%. Power conversion efficiency is a parameter representing the ratio of the power contributing to heat generation by the electrically conductive layer to the power input to the fixing device. Thus, even when the fixing device is designed as a device that can output power of 1000 W at the maximum, about 450 W is lost. This loss is used for heat generation by the coil and the magnetic core.

In this configuration, when the fixing device is started up, the coil temperature may exceed 200° C. when power of 1000 W is input even for a several seconds. Considering that the heatproof temperature of the insulating material of the coil is about 250 to 300° C., and the Curie temperature of the magnetic core formed of ferrite is typically from about 200 to 250° C., it is unlikely that the temperature of the members, for example the energizing coil, is maintained at equal to or lower than the heatproof temperature when 45% of the power is lost. Furthermore, when the temperature of the magnetic core exceeds the Curie temperature, the inductance of the coil steeply reduces, thereby causing variation of the load.

Since about 45% of the power supplied to the fixing device is not used for heat generation by the electrically conductive layer, in order to supply power of 900 W (assuming 90% of 1000 W) to the electrically conductive layer, about 1636 W is required to be supplied. This means a power source that consumes 16.36 A when 100 V is input. This may exceed the allowable current able to be input through an attachment plug for commercial alternating current. Thus, with the fixing device P1 of power conversion efficiency of 54.4%, power supplied to the fixing device may be insufficient.

Fixing Device P2

In this configuration, the sectional area of the magnetic core is the same as that of P1, the diameter of the electrically conductive layer is 127.3 mm, and the ratio of the magnetic flux passing through the outside route is 71.2%. Power conversion efficiency of this device obtained with the impedance analyzer is 70.8%. An increase in temperature of the coil and the core may cause a problem depending on the performance of the fixing device. When the fixing device of this configuration is a high-performance device that can print 60 sheets per minute, the rotation speed of the electrically conductive layer is 330 mm/sec and the temperature of the electrically conductive layer is required to be maintained at 180° C. In order to maintain the temperature of the electrically conductive layer at 180° C., the temperature of the magnetic core may exceed 240° C. in 20 seconds. Since the Curie temperature of the ferrite used for the magnetic core is typically about 200 to 250° C., the temperature of the ferrite may exceed the Curie temperature, resulting in steep reduction in the permeability of the magnetic core. This may lead to a situation in which the magnetic core cannot appropriately direct the lines of magnetic force. As a result, it is unlikely in some cases that the circulating current J is guided so as to cause the electrically conductive layer to generate heat.

Thus, it is desirable that the fixing device, in which the ratio of the magnetic flux passing through the outside route is within the range R1, be provided with a cooling device that reduces the temperature of the ferrite core when the fixing device is the above-described high-performance device. Examples of the cooling device can include a cooling fan, a water cooling device, a heat dissipating plate, a heat dissipating fin, a heat pipe, and a Peltier device. Of course, when such high performance is not required for this configuration, the cooling device is not required.

Fixing Device P3

In this configuration, the sectional area of the magnetic core is the same as that of P1 and the diameter of the electrically conductive layer is 63.7 mm. Power conversion efficiency of this device obtained with the impedance analyzer is 83.9%. Although heat is constantly generated in the components such as the magnetic core and the coil, the degree of heat generation in this device is such that the cooling device is not required. When the fixing device of this configuration is a high-performance device that can print 60 sheets/minute, the rotation speed of the electrically conductive layer is 330 mm/sec and the surface temperature of the electrically conductive layer may be maintained at 180° C. Despite this, the temperature of the magnetic core (ferrite) does not increase to equal to or higher than 220° C. Thus, in this configuration, when the fixing device is the above-described high-performance device, it is desirable that a ferrite, the Curie temperature of which is equal to or higher than 220° C., be used.

Thus, when the fixing device, which is configured such that the ratio of the magnetic flux passing through the outside route is in the range R2, is used as the high-performance device, it is desirable that the heat resistant design of ferrite or the like be optimized. When high performance is not required for the fixing device, such heat resistant design is not required.

Fixing Device P4

In this configuration, the sectional area of the magnetic core is the same as that of P1 and the diameter of a cylindrical body is 47.7 mm. Power conversion efficiency of this device obtained with the impedance analyzer is 94.7%. Even when the fixing device of this configuration is the high-performance device that can print 60 sheets/minute (the rotation speed of the electrically conductive layer is 330 mm/sec), and the surface temperature of the electrically conductive layer is maintained at 180° C., the temperatures of the components such as the magnetic core and the coil do not reach a temperature equal to or higher than 180° C. Thus, neither the cooling device that cools the components such as the magnetic core and the coil nor a particular heat resistant design is required.

Thus, in the range R3, where the ratio of the magnetic flux passing through the outside route is equal to or more than 94.7%, power conversion efficiency becomes equal to or more than 94.7%. Thus, power conversion efficiency is sufficiently high. Thus, the cooling device is not required even when the fixing device is used as the high-performance fixing device.

Furthermore, in the range R3 where power conversion efficiency is stabilized at a high value, even when the amount per unit time of the magnetic flux passing through the inside of the electrically conductive layer slightly varies due to variation of the positional relationship between the electrically conductive layer and the magnetic core, the amount of variation of power conversion efficiency is small, and accordingly, the amount of heat generated by the electrically conductive layer is stable. When the fixing device uses a flexible film or the like, the distance between the electrically conductive layer and the magnetic core is likely to vary. In this case, the range R3 where power conversion efficiency is stabilized at a high value is very useful.

Thus, it can be understood that, in order to satisfy at least a required power conversion efficiency, it is required that the ratio of the magnetic flux passing through the outside route be equal to or more than 72% in the fixing device of the present embodiment (although the ratio is equal to or more than 71.2% according to Table 3, it is assumed to be equal to or more than 72% with consideration of measurement errors or the like).

(5) Relationship of Permeance or Reluctance to be Satisfied by Device

A state in which the ratio of the magnetic flux passing through the outside route of the electrically conductive layer is equal to or more than 72% is equivalent to a state in which the sum of the permeance of the electrically conductive layer and the permeance inside the electrically conductive layer (region between the electrically conductive layer and the magnetic core) is equal to or less than 28% of the permeance of magnetic core. Thus, one of the characteristic configurations of the present embodiment is that, when the permeance of the magnetic core is $P_c$, the permeance inside the electrically conductive layer is $P_a$, and the permeance of the electrically conductive layer is $P_s$, the following equation (31) is satisfied:

$$0.28\times P_c \geq P_s + P_a \quad (31).$$

When permeance is replaced with reluctance in the relationship of the permeance, the following equation (32) is obtained:

$$\begin{aligned} &0.28\times P_C \geq P_S + P_a \\ &0.28\times \frac{1}{R_c} \geq \frac{1}{R_s} + \frac{1}{R_a} \\ &0.28\times \frac{1}{R_c} \geq \frac{1}{R_{sa}} \\ &0.28\times R_{sa} \geq R_c. \end{aligned} \quad (32)$$

The combined reluctance $R_{sa}$ of $R_s$ and $R_a$ is calculated as expressed by the following equation (33):

$$\begin{aligned} &\frac{1}{R_c} = \frac{1}{R_s} + \frac{1}{R_a} \\ &R_{sa} = \frac{R_a \times R_s}{R_a + R_s} \end{aligned} \quad (33)$$

where $R_c$ is the reluctance of the magnetic core, $R_s$ is the reluctance of the electrically conductive layer, $R_a$ is the reluctance of the region between the electrically conductive layer and the magnetic core, and $R_{sa}$ is the combined reluctance of $R_s$ and $R_a$.

The above-described relationship of permeance or reluctance can be satisfied in a section perpendicular to the generatrix direction of the cylindrical rotating member in the entirety of a maximum recording medium conveying region in the fixing device.

Likewise, in the fixing device for range R2 of the present embodiment, the ratio of the magnetic flux passing through the outside route of the electrically conductive layer is equal to or more than 92% (although the ratio is equal to or more than 91.7% according to Table 3, the ratio is assumed to be equal to or more than 92% with consideration for measurement errors or the like). A state in which the ratio of the magnetic flux passing through the outside route of the electrically conductive layer is equal to or more than 92% is equivalent to a state in which the sum of the permeance of the electrically conductive layer and the permeance inside the electrically conductive layer (region between the electrically conductive layer and the magnetic core) is equal to or less than 8% of the permeance of magnetic core. The relationship of permeance is expressed in the following equation (34):

$$0.08\times P_c \geq P_s + P_a \quad (34).$$

When the above-described relationship of permeance is converted into a relationship of reluctance, it is expressed in the following equation (35):

$$\begin{aligned} &0.08\times P_c \geq P_s + P_a \\ &0.08\times R_{sa} \geq R_c \end{aligned} \quad (35).$$

Furthermore, in the fixing device for range R3 of the present embodiment, the ratio of the magnetic flux passing through the outside route of the electrically conductive layer is equal to or more than 95% (although the ratio is equal to or more than 94.7% according to Table 3, the ratio is assumed to be equal to or more than 95% with consideration of measurement errors or the like). The relationship of permeance is expressed in equation (36) below. A state in which the ratio of the magnetic flux passing through the outside route of the electrically conductive layer is equal to or more than 95% is equivalent to a state in which the sum of the permeance of the electrically conductive layer and the permeance inside the electrically conductive layer (region between the electrically conductive layer and the magnetic core) is equal to or less than 5% of the permeance of magnetic core. The relationship of permeance is expressed in the following equation (36):

$$0.05\times P_c \geq P \geq P_s + P_a \quad (36).$$

When the above-described relationship expressed in equation (36) of permeance is converted into a relationship of reluctance, it is expressed in the following equation (37):

$$0.05\times P_c \geq P_s + P_a$$

$$0.05\times R_{sa} \geq R_c \quad (37).$$

Figure 14:
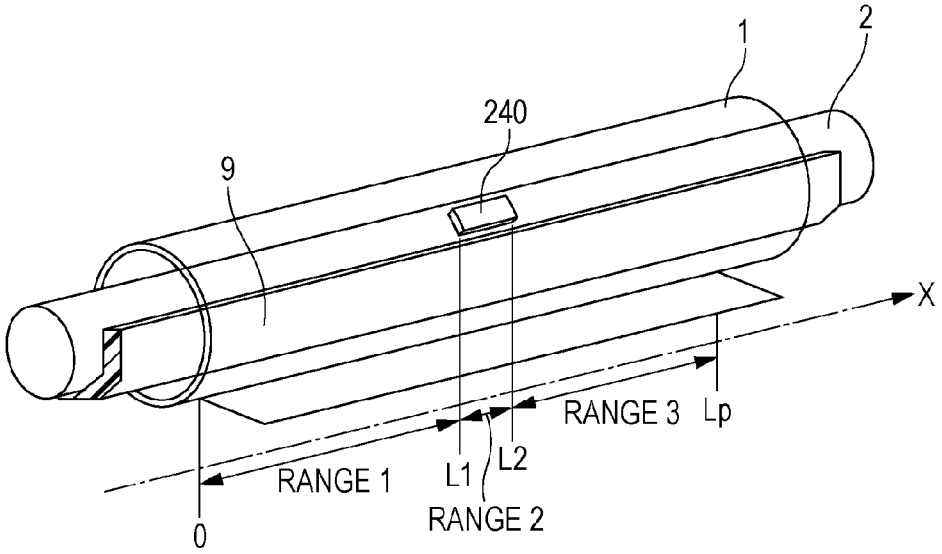
FIG. 14 is a perspective view of the magnetic core, a temperature detecting member, and the film that includes an electrically conductive layer.

The relationships of permeance and reluctance have been described for the fixing device, in which the components and the like have a uniform sectional structure in the longitudinal direction in the maximum image region of the fixing device. Hereafter, a fixing device, in which the components included in the fixing device have a non-uniform sectional structure in the longitudinal direction, will be described. Referring to FIG. 14, a temperature detecting member 240 is provided inside the electrically conductive layer (region between the magnetic core and the electrically conductive layer). The fixing device includes the film 1, which includes the electrically conductive layer, the magnetic core 2, and the backup member (film guide) 9.

Figure 15A:
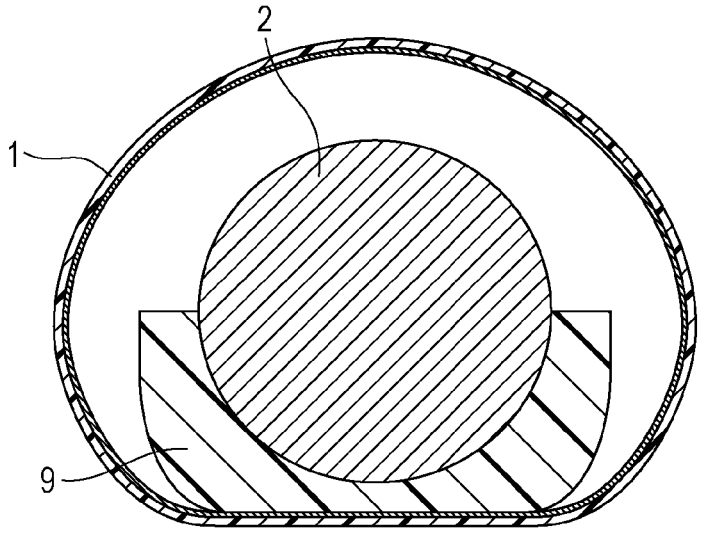
FIGS. 15A and 15B are sectional views of the magnetic core, the temperature detecting member, and the film that includes the electrically conductive layer.
Figure 15B:
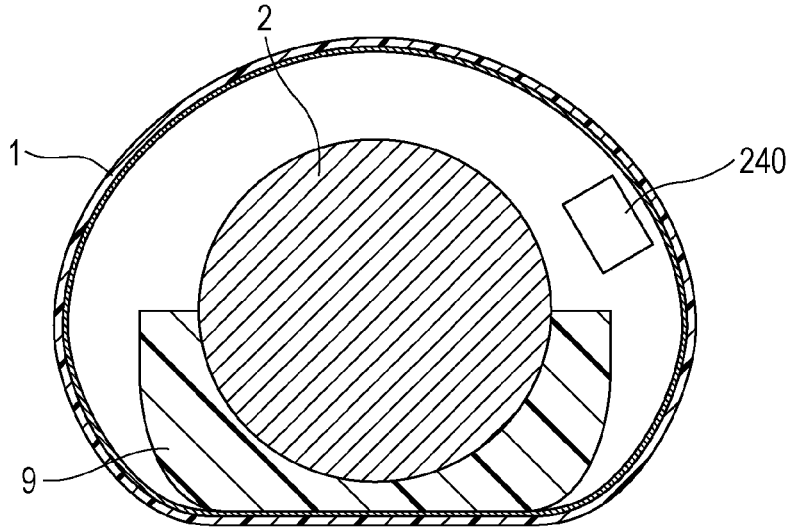

When the longitudinal direction of the magnetic core 2 is defined as the X direction, a maximum image forming region is from 0 to Lp on the X axis. For example, in the case of an image forming device in which the maximum recording medium conveying range is 215.9 mm for a letter (LTR) size, Lp can be set to 215.9 mm. The temperature detecting member 240 includes a non-magnetic member, the relative magnetic permeability of which is 1. The sectional area of the temperature detecting member 240 is 5 mm×5 mm in a direction perpendicular to the X axis, and the length of the temperature detecting member 240 in a direction parallel to the X axis is 10 mm. The temperature detecting member 240 is disposed in a range from L1 (102.95 mm) to L2 (112.95 mm) on the X axis. Here, a range from 0 to L1 on the X axis is referred to as range 1, a range from L1 to L2, in which the temperature detecting member 240 is disposed, is referred to as range 2, and a range from L2 to LP is referred to as range 3. The sectional structure in range 1 is illustrated in FIG. 15A and the sectional structure in range 2 is illustrated in FIG. 15B. As illustrated in FIG. 15B, the temperature detecting member 240, which is contained in the film 1, is included in magnetic reluctance calculation. In order to exactly perform the magnetic reluctance calculation, "reluctance per unit lengths" are separately obtained for ranges 1 to 3 and integrated in accordance with the lengths of ranges 1 to 3. The results are summed to obtain a combined reluctance. Initially, the reluctances per unit length of the components in ranges 1 to 3 are listed in Table 4 below.

TABLE 4

| Parameter | Unit | Magnetic core | Film guide | Inside electrically conductive layer | Electrically conductive layer |
|---|---|---|---|---|---|
| Sectional area | m^2 | 1.5E−04 | 1.0E−04 | 2.0E−04 | 1.5E−06 |
| Relative permeability | | 1800 | 1 | 1 | 1 |
| Permeability | H/m | 2.3E−03 | 1.3E−06 | 1.3E−06 | 1.3E−06 |
| Permeance per unit length | H · m | 3.5E−07 | 1.3E−10 | 2.5E−10 | 1.9E−12 |
| Reluctance per unit length | 1/(H · m) | 2.9E+06 | 8.0E+09 | 4.0E+09 | 5.3E+11 |

The reluctance per unit length $r_c$1 of the magnetic core in range 1 is as follows:

$$r_c1=2.9\times10^6[(1/(H\cdot m)].$$

Here, the reluctance per unit length $r_a$ of the region between the electrically conductive layer and the magnetic core is a combined reluctance of the reluctance per unit length $r_f$ of the film guide and the reluctance per unit length $r_{air}$ of the inside of the electrically conductive layer. Thus, the following equation (38) can be used for the calculation:

$$\frac{1}{r_a} = \frac{1}{r_f} + \frac{1}{r_{air}}. \quad (38)$$

As a result of the calculation, the reluctance $r_a$1 in range 1 and the reluctance $r_s$1 in range 1 are as follows:

$$r_a1=2.7\times10^9[1/(H\cdot m)]$$

$$r_s1=5.3\times10^{11}[1/(H\cdot m)].$$

Since range 3 is the same as range 1, the reluctances in range 3 are as follows:

$$r_c3=2.9\times10^6[(1/(H\cdot m)]$$

$$r_a3=2.7\times10^9[1/(H\cdot m)]$$

$$r_s3=5.3\times10^{11}[1/(H\cdot m)].$$

Next, the reluctances per unit length of the components in range 2 are listed in Table 5 below.

TABLE 5

| Parameter | Unit | Magnetic core c | Film guide | Thermistor | Inside electrically conductive layer | Electrically conductive layer |
|---|---|---|---|---|---|---|
| Sectional area | m^2 | 1.5E−04 | 1.0E−04 | 2.5E−05 | 1.72E−04 | 1.5E−06 |
| Relative permeability | | 1800 | 1 | 1 | 1 | 1 |
| Permeability | H/m | 2.3E−03 | 1.3E−06 | 1.3E−06 | 1.3E−06 | 1.3E−06 |
| Permeance per unit length | H · m | 3.5E−07 | 1.3E−10 | 3.1E−11 | 2.2E−10 | 1.9E−12 |
| Reluctance per unit length | 1/(H · m) | 2.9E+06 | 8.0E+09 | 3.2E+10 | 4.6E+09 | 5.3E+11 |

The reluctance per unit length $r_c$2 of the magnetic core in range 2 is as follows:

$$r_c2=2.9\times10^6[(1/(H\cdot m)].$$

The reluctance per unit length $r_a$ of the region between the electrically conductive layer and the magnetic core is a combined reluctance of the reluctance per unit length $r_f$ of the film guide, the reluctance per unit length $r_t$ of the thermistor, and the reluctance per unit length $r_{air}$ of the air inside the electrically conductive layer. Thus, the following equation (39) can be used for the calculation:

$$\frac{1}{r_a}=\frac{1}{r_t}+\frac{1}{r_f}+\frac{1}{r_{air}}. \tag{39}$$

As a result of the calculation, the reluctance per unit length $r_a$2 and the reluctance per unit length $r_c$2 in range 2 are as follows:

$$r_a2=2.7\times10^9[1/(H\cdot m)]$$

$$r_s2=5.3\times10^{11}[1/(H\cdot m)].$$

The calculation method for range 3 is the same as that for range 1 and description thereof is omitted.

The reluctances per unit length $r_a$ in the region between the electrically conductive layer and the magnetic core are $r_a$1=$r_a$2=$r_a$3. The reason for this is described as follows. That is, in the reluctance calculation for range 2, the sectional area of the thermistor 240 is increased and the sectional area of the air inside the electrically conductive layer is reduced. However, since the relative permeabilities of both the thermistor 240 and the air are 1, the reluctances are the same with or without the thermistor 240. That is, in the case where only a non-magnetic material is disposed in the region between the electrically conductive layer and the magnetic core, reluctance can be sufficiently accurately calculated even when the non-magnetic material is treated similarly to the air. The reason for this is that the relative permeability of the non-magnetic material is substantially 1. In contrast, in the case of a magnetic material (nickel, steel, silicon steel, or the like), reluctance for a region where the magnetic material is disposed can be calculated separately from that for other regions.

Regarding the reluctance R [A/Wb(1/H)] as a combined reluctance in the generatrix direction of the electrically conductive layer, the integrals can be calculated from the reluctances r1, r2, and r3 [1/(H·m)] of the regions as expressed by the following equation (40):

$$\begin{aligned}R&=\int_0^{L1}r1\,dl1+\int_{L1}^{L2}r2\,dl1+\int_{L2}^{Lp}r3\,dl1\\&=r1(L1-0)+r2(L2-L1)+r3(LP-L2).\end{aligned} \tag{40}$$

Thus, the reluctance $R_c$[H] of the core in an interval from one end to the other end of the maximum recording medium conveying range can be calculated as expressed in the following equation (41):

$$\begin{aligned}R_c&=\int_0^{L1}r_c1\,dl1+\int_{L1}^{L2}r_c2\,dl1+\int_{L2}^{Lp}r_c3\,dl1\\&=r_c1(L1-0)+r_c2(L2-L1)+r_c3(LP-L2).\end{aligned} \tag{41}$$

Also, the combined reluctance $R_a$ [H] of the region between the electrically conductive layer and the magnetic core in the interval from one end to the other end of the maximum recording medium conveying range can be calculated as expressed in the following equation (42):

$$\begin{aligned}R_a&=\int_0^{L1}r_a1\,dl1+\int_{L1}^{L2}r_a2\,dl1+\int_{L2}^{Lp}r_a3\,dl1\\&=r_a1(L1-0)+r_a2(L2-L1)+r_a3(LP-L2).\end{aligned} \tag{42}$$

The combined reluctance $R_s$ [H] of the electrically conductive layer in the interval from one end to the other end of the maximum recording medium conveying range is as expressed in the following equation (43):

$$\begin{aligned}R_s&=\int_0^{L1}r_s1\,dl1+\int_{L1}^{L2}r_s2\,dl1+\int_{L2}^{Lp}r_s3\,dl1\\&=r_s1(L1-0)+r_s2(L2-L1)+r_s3(LP-L2).\end{aligned} \tag{43}$$

Table 6 below lists the results of the above-described calculations for each of the ranges:

TABLE 6

| | Range 1 | Range 2 | Range 3 | Combined reluctance |
|---|---|---|---|---|
| Integration start point (in mm) | 0 | 102.95 | 112.95 | |
| Integration end point (in mm) | 102.95 | 112.95 | 215.9 | |
| Distance (in mm) | 102.95 | 10 | 102.95 | |
| Permeance $p_c$ per unit length [H · m] | 3.5E−07 | 3.5E−07 | 3.5E−07 | |
| Reluctance $r_c$ per unit length [1/(H · m)] | 2.9E+06 | 2.9E+06 | 2.9E+06 | |
| Integration of reluctance $r_c$ [A/Wb(1/H)] | 3.0E+08 | 2.9E+07 | 3.0E+08 | 6.2+08 |
| Permeance $p_a$ per unit length [H · m] | 3.7E−10 | 3.7E−10 | 3.7E−10 | |
| Reluctance $r_a$ per unit length [1/(H · m)] | 2.7E+09 | 2.7E+09 | 2.7E+09 | |
| Integration of reluctance $r_a$ [A/Wb(1/H)] | 2.8E+11 | 2.7E+10 | 2.8E+11 | 5.8E+11 |
| Permeance $p_s$ per unit length [H · m] | 1.9E−12 | 1.9E−12 | 1.9E−12 | |
| Reluctance $r_s$ per unit length [1/(H · m)] | 5.3E+11 | 5.3E+11 | 5.3E+11 | |
| Integration of reluctance $r_s$ [A/Wb(1/H)] | 5.4E+13 | 5.3E+12 | 5.4E+13 | 1.1E+14 |

According to Table 6 above, $R_c$, $R_a$, and $R_s$ are as follows:

$$R_c=6.2\times10^8[1/H]$$

$$R_a=5.8\times10^{11}[1/H]$$

$$R_s=1.1\times10^{14}[1/H].$$

The combined reluctance $R_{sa}$ of $R_s$ and $R_a$ can be calculated by the following equation (44):

$$\frac{1}{R_{sa}}=\frac{1}{R_s}+\frac{1}{R_a} \tag{44}$$

$$R_{sa}=\frac{R_a\times R_s}{R_a+R_s}.$$

From the above-described calculation, $R_{sa}=5.8\times10^{11}$ [1/H], which satisfies the following equation (45):

$$0.28\times R_{sa}\geq R_c \tag{45}.$$

Thus, for the fixing device having a non-uniform cross-sectional shape in the generatrix direction of the electrically conductive layer, a plurality of ranges are defined in the generatrix direction of the electrically conductive layer and reluctance is calculated for each of the ranges. Then, at last, permeance or reluctance may be calculated by combining permeances or reluctances of the ranges. However, when an objective component is formed of a non-magnetic material, since the permeability of a non-magnetic material is substantially equal to that of the air, the non-magnetic component may be regarded as the air in the calculation. Next, components to be included in the above-described calculation are described. The permeance or reluctance of a component can be included in the calculation when the component is disposed in the region between the electrically conductive layer and the magnetic core, and at least part of the component is disposed within the maximum recording medium conveying range (0 to Lp). In contrast, it is not required that the permeance or the reluctance of a component disposed outside the electrically conductive layer be calculated. The reason for this is that, as described above, according to Faraday's law, an induced electromotive force is proportional to time variation of a magnetic flux that perpendicularly penetrates through a circuit and not related to a magnetic flux outside the electrically conductive layer. Furthermore, heat generation by the electrically conductive layer is not affected by the component disposed outside the maximum recording medium conveying range in the generatrix direction of the electrically conductive layer. Thus, calculation for such a component is not required.

As described above, as one of the conditions for the fixing device, in which the induced current flowing in the circumferential direction of the rotating member can be increased (heat generation efficiency can be improved) with the core having the ends, at least equation (31) can be satisfied.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-261512, filed Dec. 18, 2013, which is hereby incorporated by reference herein in its entirety.

What is claimed is:

1. A fixing device comprising:

a cylindrical fixing film;

a backup member in contact with an inner surface of the fixing film, the backup member backing up the fixing film;

a nip portion forming member in contact with an outer surface of the fixing film, the nip portion forming member and the backup member forming a fixing nip portion with the fixing film interposed therebetween;

a metal plate provided on a surface on a side opposite to a surface on a side where the backup member is in contact with the fixing film, the metal plate reinforcing the backup member, a coil that forms an alternating magnetic field, which causes an electrically conductive layer to generate heat by electromagnetic induction, the coil including a spirally shaped portion of which a spiral axis is substantially parallel to a qeneratrix direction of the fixing film; and a core disposed inside the spirally shaped portion, the core directing lines of magnetic force of the alternating magnetic field, wherein a recording material carrying an unfixed image is conveyed at the fixing nip portion, and the unfixed image is fixed on the recording material by heat at the fixing nip portion, wherein the metal plate has a flat portion pressed against the backup member, wherein the fixing film includes the electrically conductive layer, and wherein the device causes a circulating current that flows in a circumferential direction of the fixing film, to flow through the electrically conductive layer of the fixing film, thereby causing the entire fixing film in the circumferential direction of the fixing film to generate heat, and wherein the current that flows through the electrically conductive layer in the circumferential direction is induced by the alternating magnetic field, thereby causing the electrically conductive layer to generate heat, and wherein the device satisfies the following equations:

$$0.28\times R_{sa}>R_c$$

$$1/R_{sa}=1/R_s+1/R_a$$

where $R_c$ is a reluctance of a magnetic core $R_s$ is a reluctance of the electrical conductive layer, $R_a$ is a reluctance of a region between the electrical conductive layer and the magnetic core, and $R_{sa}$ is a combined reluctance of $R_s$ and $R_a$.

2. The fixing device according to claim 1, wherein a section of the metal plate has a U shape, and a bottom portion of the U shape serves as the flat portion pressed against the backup member.

3. The fixing device according to claim 2, wherein, in a section of the fixing device seen from one end in the generatrix direction, the core is located in a region surrounded by the bottom portion and two leg portions of the U shape.

4. The fixing device according to claim 3, wherein, in a section of the fixing device seen from one end in the generatrix direction, equal to or more than 20% of an area of the core is located in the region surrounded by the bottom portion and the two leg portions of the U shape.

5. The fixing device according to claim 4, wherein, in a section of the fixing device seen from one end in the generatrix direction, a ratio of the area of the core to an area of the region surrounded by the bottom portion and the two leg portions of the U shape is equal to or more than 20%.

6. The fixing device according to claim 1, a length of the fixing film on the fixing nip portion side relative to a virtual plane drawn by extending the flat portion is equal to or more than 20% of a length of the fixing film in the circumferential direction.

7. The fixing device according to claim 1, wherein the electrically conductive layer is formed of silver, aluminum, austenitic stainless steel, copper, or an alloy of one of silver, aluminum, austenitic stainless steel, and copper.

8. The fixing device according to claim 1, wherein the metal plate is formed of austenitic stainless steel, aluminum, or an alloy of austenitic stainless steel or aluminum.

9. A fixing device comprising:

a rotatable member;

a backup member in contact with an inner surface of the rotatable member, the backup member backing up the rotatable member;

a nip portion forming member in contact with an outer surface of the rotatable member, the nip portion forming member and the backup member forming a fixing nip portion with the rotatable member interposed therebetween;

a reinforcing member provided on a surface on a side opposite to a surface on a side where the backup member is in contact with the rotatable member, the reinforcing member reinforcing the backup member, a coil that forms an alternating magnetic field, which causes an electrically conductive layer to generate heat by electromagnetic induction, the coil including a spirally shaped portion of which a spiral axis is substantially parallel to a qeneratrix direction of the rotatable member; and a core disposed inside the spirally shaped portion, the core directing lines of magnetic force of the alternating magnetic field, wherein a recording material carrying an unfixed image is conveyed at the fixing nip portion, and the unfixed image is fixed on the recording material by heat at the fixing nip portion, wherein the reinforcing member has a flat portion pressed against the backup member and leg portions bent in a direction vertical to the flat portion, and wherein the device causes a current to flow through the entire rotatable member in a circumferential direction of the rotatable member, thereby causing the entire rotatable member in the circumferential direction of the rotatable member to generate heat, and wherein the current that flows through the rotatable member is induced by the alternating magnetic field, thereby causing the rotatable member to generate heat, and wherein the device satisfies the following equations:

$$0.28\times R_{sa}>R_c$$

$$1/R_{sa}=1/R_s+1/R_a$$

where $R_c$ is a reluctance of a magnetic core, $R_s$ is a reluctance of the rotatable member, $R_a$ is a reluctance of a region between the rotatable member and the magnetic core, and $R_{sa}$ is a combined reluctance of $R_s$ and $R_a$.

10. The fixing device according to claim 9, further comprising:

a coil that forms an alternating magnetic field, which causes the rotatable member to generate heat by electromagnetic induction, the coil including a spirally shaped portion of which a spiral axis is substantially parallel to a generatrix direction of the rotatable member; and a core disposed inside the spirally shaped portion, the core directing lines of magnetic force of the alternating magnetic field, wherein a current that flows through the rotatable member in the circumferential direction is induced by the alternating magnetic field, thereby causing the rotatable member to generate heat.

11. The fixing device according to claim 10, wherein, in a section of the fixing device seen from one end in the generatrix direction, the core is located in a region surrounded by the flat portion and the leg portions.

12. The fixing device according to claim 11, wherein, in a section of the fixing device seen from one end in the generatrix direction, equal to or more than 20% of an area of the core is located in the region surrounded by the flat portion and the leg portions.

13. The fixing device according to claim 12, wherein, in a section of the fixing device seen from one end in the generatrix direction, a ratio of the area of the core to an area of the region surrounded by the flat portion and the leg portions is equal to or more than 20%.

14. The fixing device according to claim 9, wherein a length of the rotatable member on the fixing nip portion side relative to a virtual plane drawn by extending the flat portion is equal to or more than 20% of a length of the rotatable member in the circumferential direction.

15. The fixing device according to claim 9, wherein the rotatable member includes an electrically conductive layer, and wherein the electrically conductive layer is formed of silver, aluminum, austenitic stainless steel, copper, or an alloy of one of silver, aluminum, austenitic stainless steel, and copper.

16. The fixing device according to claim 9, wherein the reinforcing member is formed of austenitic stainless steel, aluminum, or an alloy of austenitic stainless steel or aluminum.

* * * * *